US006097307A

United States Patent [19]

Utz

[11] Patent Number: 6,097,307

[45] **Date of Patent: *Aug. 1, 2000**

[54] SECURITY SYSTEM WITH RANDOMIZED SYNCHRONIZATION CODE

[75] Inventor: Hubert W. Utz, München, Germany

[73] Assignee: National Semiconductor Corporation, Santa Clara, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/915,552

[22] Filed: Aug. 15, 1997

Related U.S. Application Data

[63] Continuation of application No. 08/145,471, Oct. 29, 1993, Pat. No. 5,680,131.

[51] Int. Cl.[7] ..... G07D 7/00

[52] U.S. Cl. ..... 340/825.34; 340/825.3; 340/825.04; 340/825.69; 341/176; 455/95; 455/97

[58] Field of Search ..... 340/825.34, 825.3, 340/825.04, 825.69, 825.72, 92, 539, 426; 341/176; 455/95, 97

[56] References Cited

U.S. PATENT DOCUMENTS

| | | | |
|---|---|---|---|
| Re. 33,189 | 3/1990 | Lee et al. | 380/20 |
| 3,622,991 | 11/1971 | Lehrer et al. | 340/147 R |
| 3,646,580 | 2/1972 | Fuller et al. | 325/53 |
| 3,654,604 | 4/1972 | Crafton | 340/147 R |
| 3,665,162 | 5/1972 | Yamamoto et al. | 235/61.7 B |
| 4,133,974 | 1/1979 | Morgan | 178/22 |
| 4,143,368 | 3/1979 | Route et al. | 340/543 |
| 4,322,577 | 3/1982 | Brändström | 178/22.05 |
| 4,418,275 | 11/1983 | Oosterbaan et al. | 377/33 |

(List continued on next page.)

FOREIGN PATENT DOCUMENTS

| | | | |
|---|---|---|---|
| 304733 | 8/1988 | European Pat. Off. . | |
| 2 144564A | 3/1985 | United Kingdom | H04L 9/00 |
| WO90/14484 | 11/1990 | WIPO . | |

OTHER PUBLICATIONS

Walter Fumy, "Kryptographie: Entwu v. Analyse symmetr. Kryptosyseinne", 1988, in German, 10 pgs.

Walter Fumy, "Kryptographie: Entwu v. Analyse symmetr. Kryptoseinne", 1988, in English, 10 pgs.

*Primary Examiner*—Michael Horabik
*Assistant Examiner*—Anthony A. Asongwed
*Attorney, Agent, or Firm*—Skjerven, Morrill, MacPherson, Franklin & Friel LLP; Norman R. Klivans

[57] ABSTRACT

A transmitting unit of a wireless security system having randomized successive ("rolling") verification codes transmits a different synchronization code each time that the transmitter unit is powered up. After power up, a pseudo-random value is generated by a pseudo-random number generator. The pseudo-random value is at least in part dependent upon a manipulation of a manually-operable switch of the transmitting unit. The pseudo-random value is incorporated into the first synchronization code transmitted after the first power up. If power to the transmitting unit is then interrupted and then resupplied, for example by removing and then replacing a battery, then the pseudo-random number generator generates another pseudo-random value, the value again depending at least in part upon a manipulation of the manually-operable switch. The pseudo-random value is then incorporated into the first synchronization code transmitted after the second power up. The first verification code used to gain access to the automobile is generated based on an initially fixed start value specific to the transmitting unit as well as on the initially randomized pseudo-random value.

32 Claims, 43 Drawing Sheets

Microfiche Appendix Included
(2 Microfiche, 97 Pages)

U.S. PATENT DOCUMENTS 4,424,414 1/1984 Hellman et al. ..... 178/22.11
4,435,826 3/1984 Matsui ..... 375/115
4,509,093 4/1985 Stellberger ..... 361/172
4,596,985 6/1986 Bongard et al. ..... 340/825.69
4,613,980 9/1986 Newlin et al. ..... 375/116
4,630,201 12/1986 White ..... 364/408
4,654,480 3/1987 Weiss ..... 380/48
4,663,626 5/1987 Smith ..... 340/825.69
4,667,301 5/1987 Chiu et al. ..... 364/717
4,691,291 9/1987 Wolfram ..... 364/717
4,733,215 3/1988 Memmola ..... 340/64
4,734,680 3/1988 Gehman et al. ..... 340/539
4,736,419 4/1988 Roe ..... 340/3
4,758,835 7/1988 Rathmann et al. ..... 340/825.31
4,771,463 9/1988 Beeman ..... 380/46
4,797,921 1/1989 Shiraishi ..... 380/28
4,800,590 1/1989 Vaughan ..... 380/25
4,825,210 4/1989 Bachhuber et al. ..... 340/825.31
4,847,614 7/1989 Keller ..... 340/825.56
4,853,884 8/1989 Brown et al. ..... 364/602
4,853,962 8/1989 Brockman ..... 380/44
4,876,718 10/1989 Citta et al. ..... 380/42
4,881,148 11/1989 Lambropoulos et al. ..... 361/172
4,905,176 2/1990 Schulz ..... 364/717
4,912,463 3/1990 Li ..... 340/825.69
4,928,098 5/1990 Dannhaeuser ..... 340/825.56
4,942,393 7/1990 Waraksa et al. ..... 340/825.72
5,001,754 3/1991 Deffeyes ..... 380/46
5,007,016 4/1991 Le Mehaute et al. ..... 364/900
5,048,086 9/1991 Bianco et al. ..... 380/28
5,054,067 10/1991 Moroney et al. ..... 380/37
5,055,701 10/1991 Takeuchi ..... 307/10.2
5,060,265 10/1991 Finkelstein ..... 380/46
5,103,221 4/1992 Memmola ..... 340/825.31
5,105,162 4/1992 Fleissner et al. ..... 329/359
5,109,152 4/1992 Takagi et al. ..... 235/380
5,109,221 4/1992 Lambropoulos et al. ..... 340/825.69
5,115,236 5/1992 Köhler ..... 340/825.69
5,136,642 8/1992 Kawamura et al. ..... 380/21
5,144,667 9/1992 Pogue, Jr. et al. ..... 340/825.32
5,146,215 9/1992 Drori ..... 340/825.32
5,161,190 11/1992 Cairns ..... 380/23
5,179,592 1/1993 Kusano ..... 380/28
5,195,136 3/1993 Hardy et al. ..... 380/43
5,220,606 6/1993 Greenberg ..... 380/43
5,222,141 6/1993 Killian ..... 380/42
5,231,667 7/1993 Kojima ..... 380/28
5,241,598 8/1993 Raith ..... 380/21
5,243,653 9/1993 Malek et al. ..... 380/48
5,272,755 12/1993 Miyaji et al. ..... 380/30
5,280,267 1/1994 Reggiani ..... 340/426
5,313,530 5/1994 Iwamura ..... 380/28
5,317,639 5/1994 Mittenthal ..... 380/37
5,319,364 6/1994 Waraksa et al. ..... 340/825.72
5,319,710 6/1994 Atalla et al. ..... 380/23
5,363,448 11/1994 Koopman, Jr. et al. ..... 340/825.31
5,365,225 11/1994 Bachhuber ..... 340/825.31
5,412,379 5/1995 Waraksa et al. ..... 340/825.72
5,436,901 7/1995 Koopman ..... 370/85.1
5,442,341 8/1995 Lambropoulos ..... 340/825.31
5,479,511 12/1995 Naccache ..... 380/28
5,511,124 4/1996 Bergner ..... 380/48
5,517,187 5/1996 Bruwer et al. ..... 340/825.3
5,517,189 5/1996 Bachhuber et al. ..... 340/825.69
5,604,488 2/1997 Lambropoulos ..... 340/825.31
5,680,131 10/1997 Utz ..... 341/176

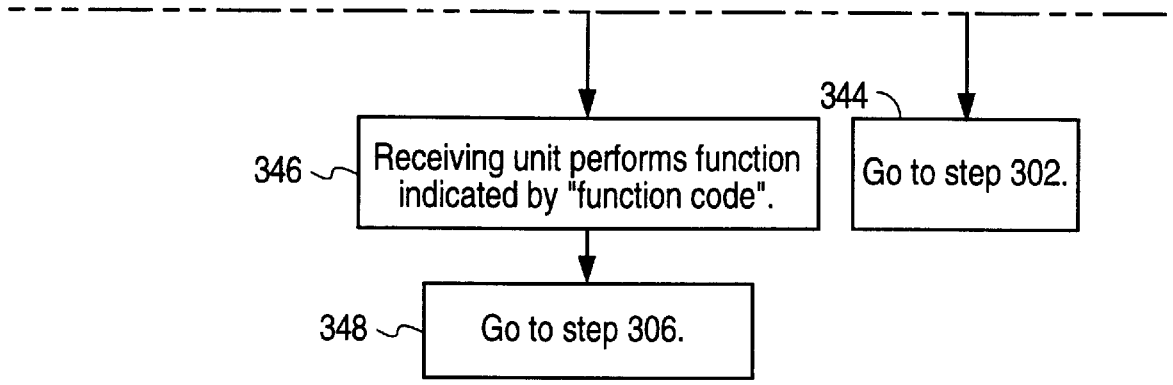
FIG.3D
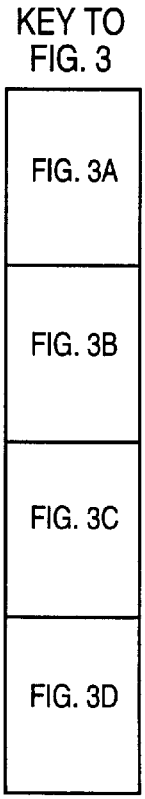

| Sync* | Key Identifier* | Synchronization Code | Data | Parity* | Pause* |
|---|---|---|---|---|---|
| 0/8 | 0/20/24 | 40 | 4 | 0/8 | 20,50 100ms |

*LENGTH OF FIELD PROGRAMMABLE

FIG. 4A

| Sync* | Key Identifier* | Verification Code | Data | Parity* | Pause* |
|---|---|---|---|---|---|
| 0/8 | 0/20/24 | 24/36 | 4 | 0/8 | 20,50 100ms |

*LENGTH OF FIELD PROGRAMMABLE

FIG. 4B

TIMER

CLK_EN

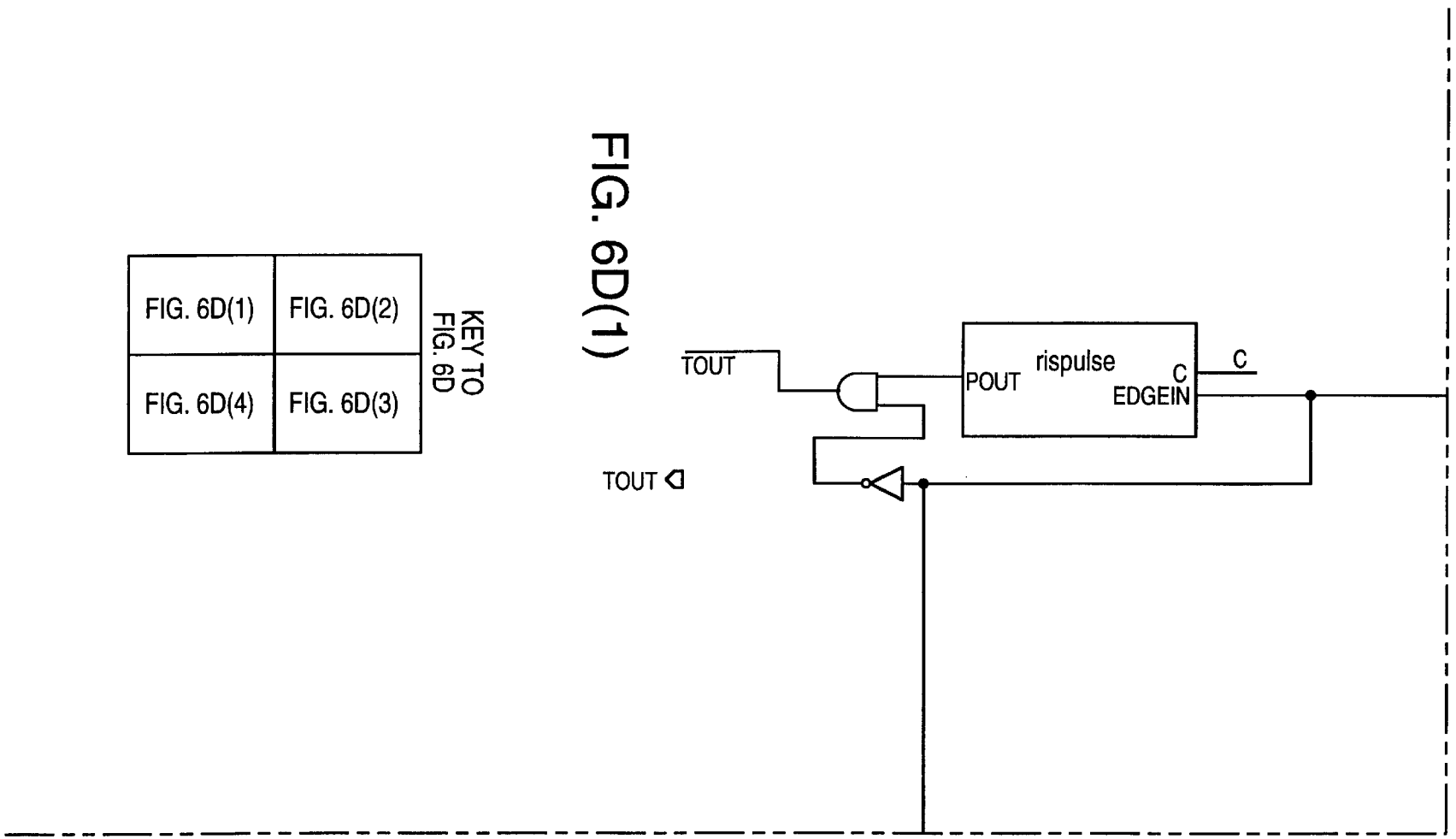
FIG. 6D(1)
KEY TO FIG. 6D
| | |
|---|---|
| FIG. 6D(2) | FIG. 6D(3) |
| FIG. 6D(1) | FIG. 6D(4) |

FIG. 6D(2)
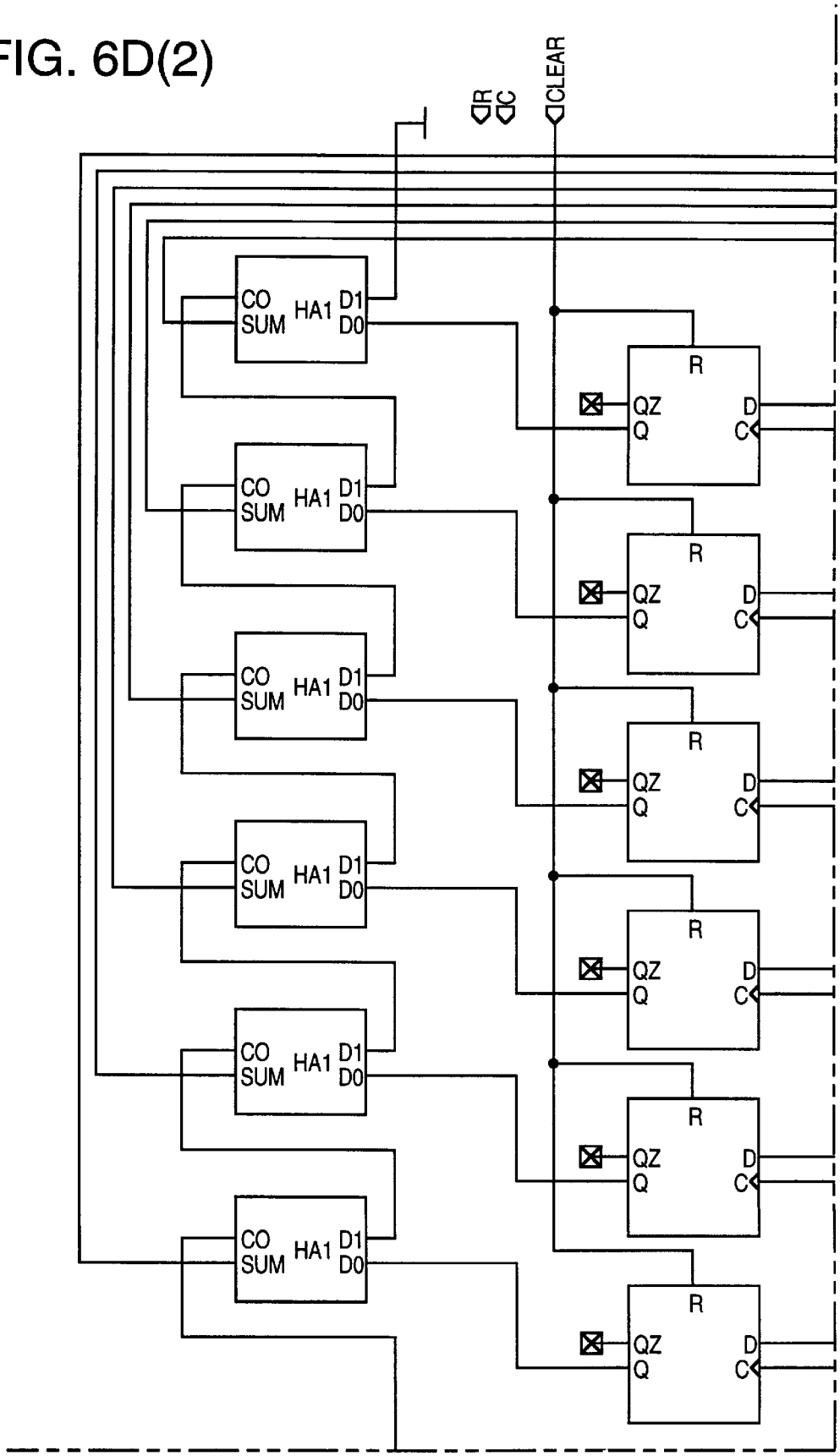

FIG. 6D(3)
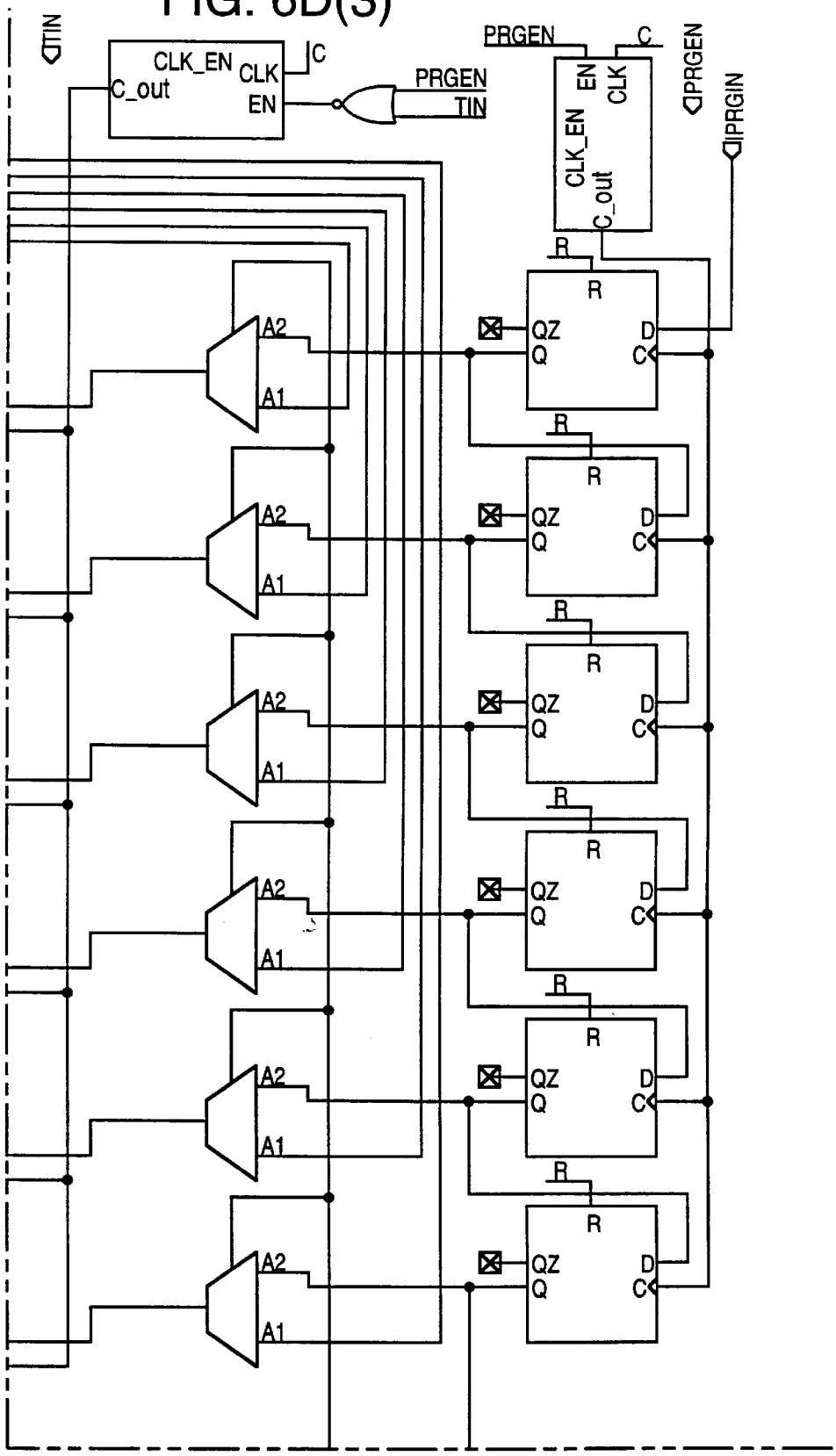

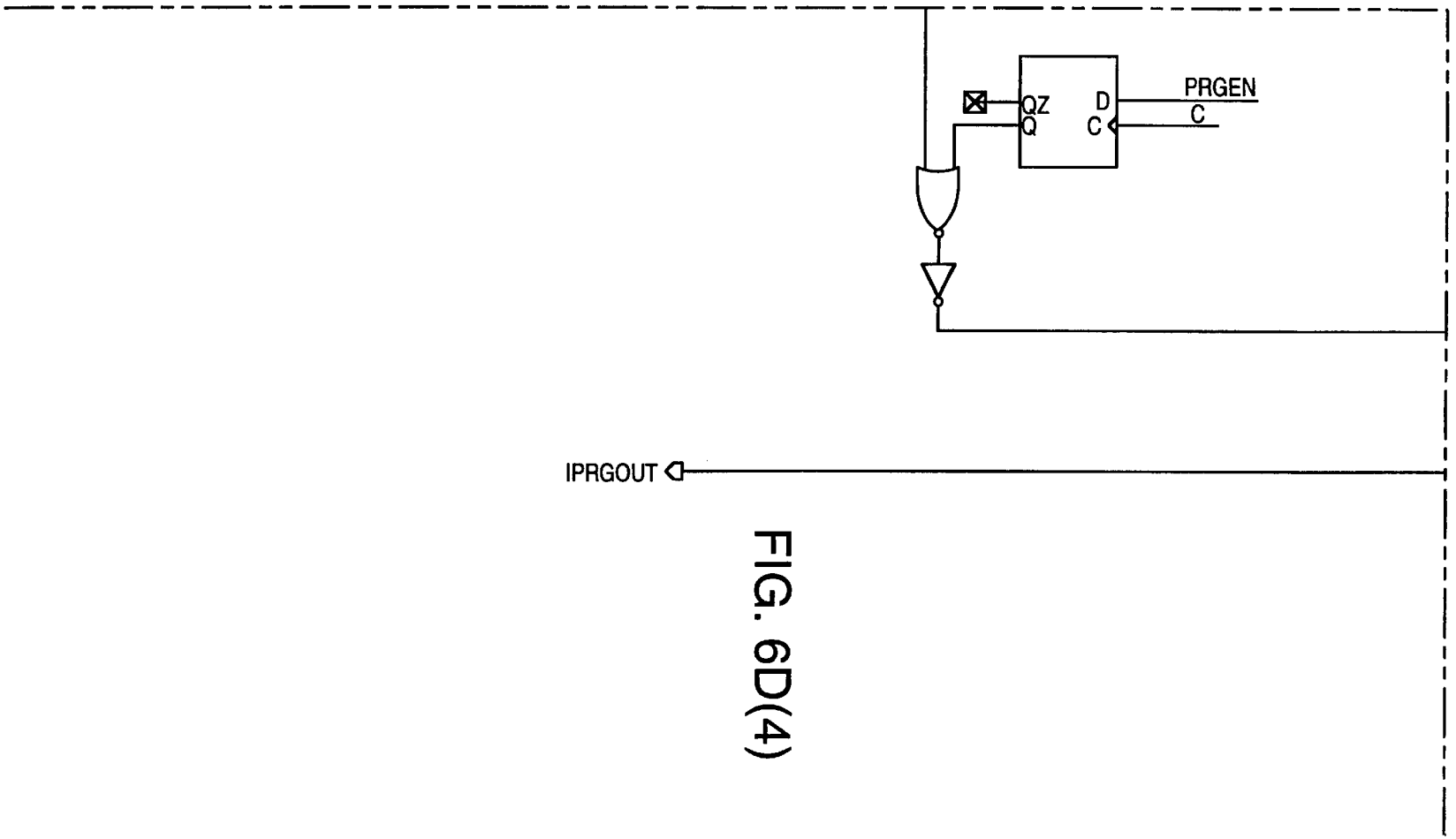
FIG. 6D(4)

rispulse

KeyDebounce

Keydeb

Keyinps

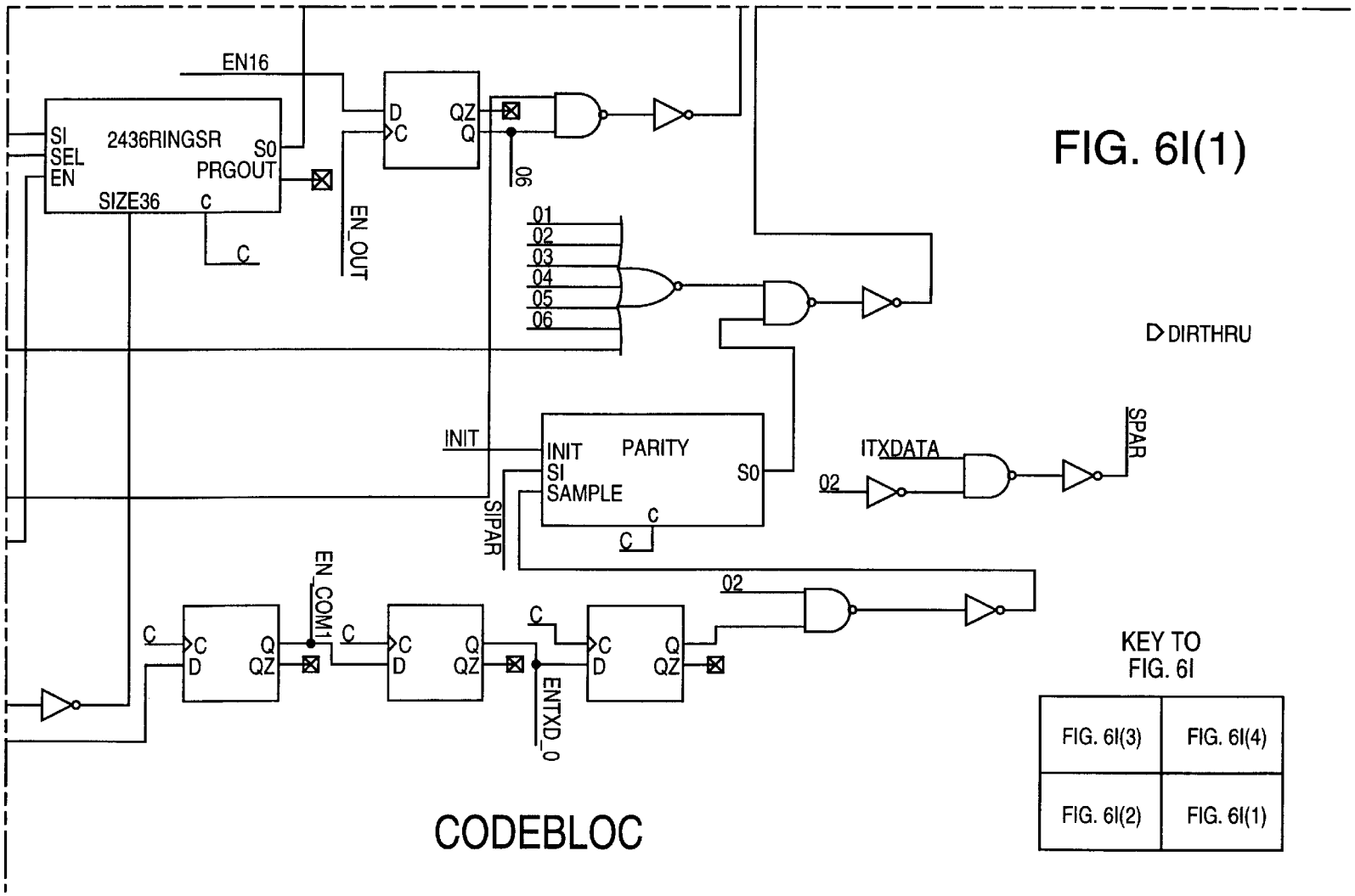
FIG. 6I(1)
DIRTHRU
SPAR
ITXDATA
Q2
KEY TO FIG. 6I
FIG. 6I(3)
FIG. 6I(2)
FIG. 6I(4)
FIG. 6I(1)
S0
PARITY
C
INIT
SI
SAMPLE
Q1
Q2
Q3
Q4
Q5
Q6
Q6
QZ
Q
D
C
SIPAR
INIT
ENTXD_0
EN_OUT
EN16
S0
PRGOUT
2436RINGSR
SIZE36
SI
SEL
EN
EN_COM1
CODEBLOC

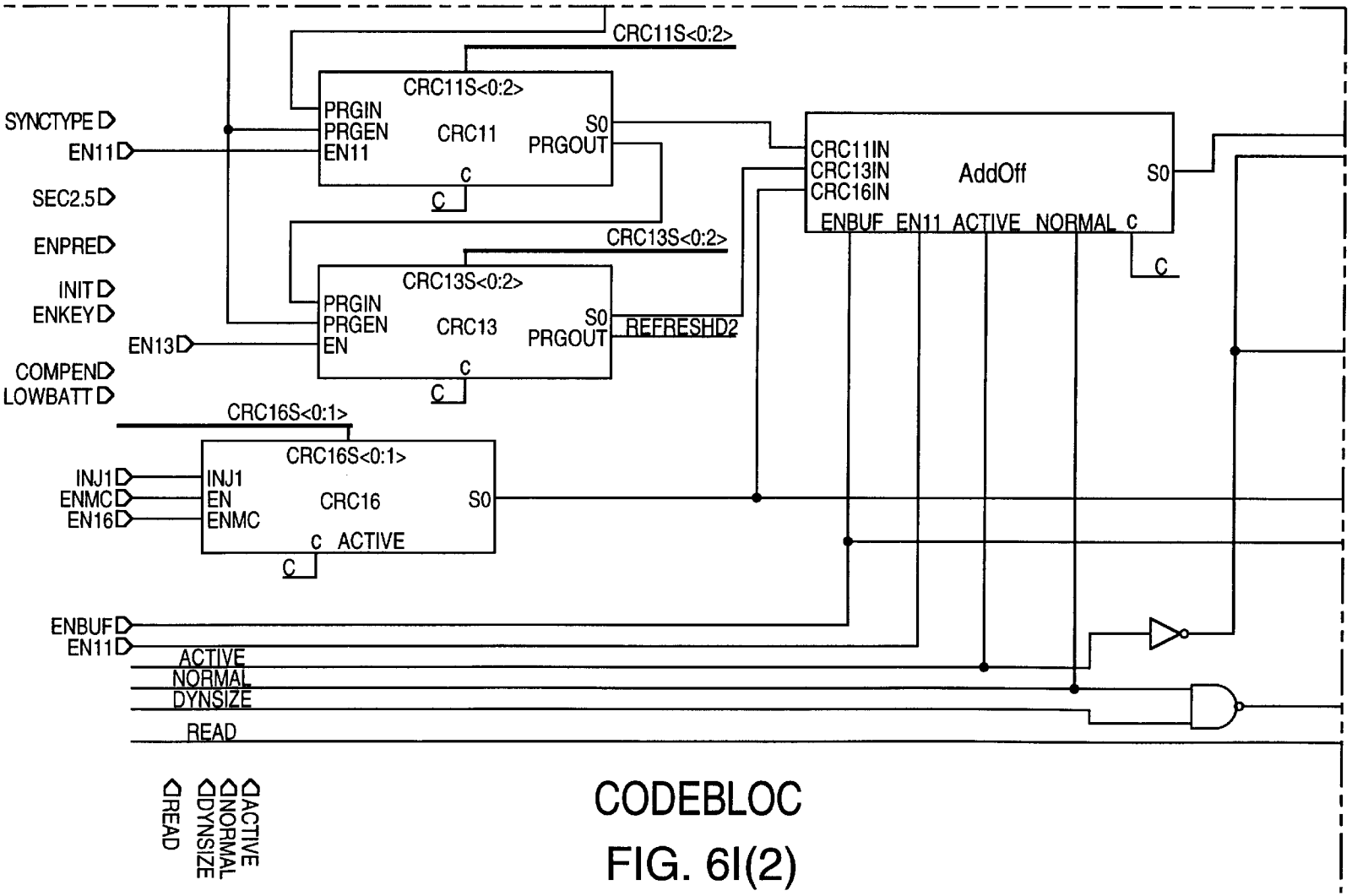
CODEBLOC
FIG. 6I(2)

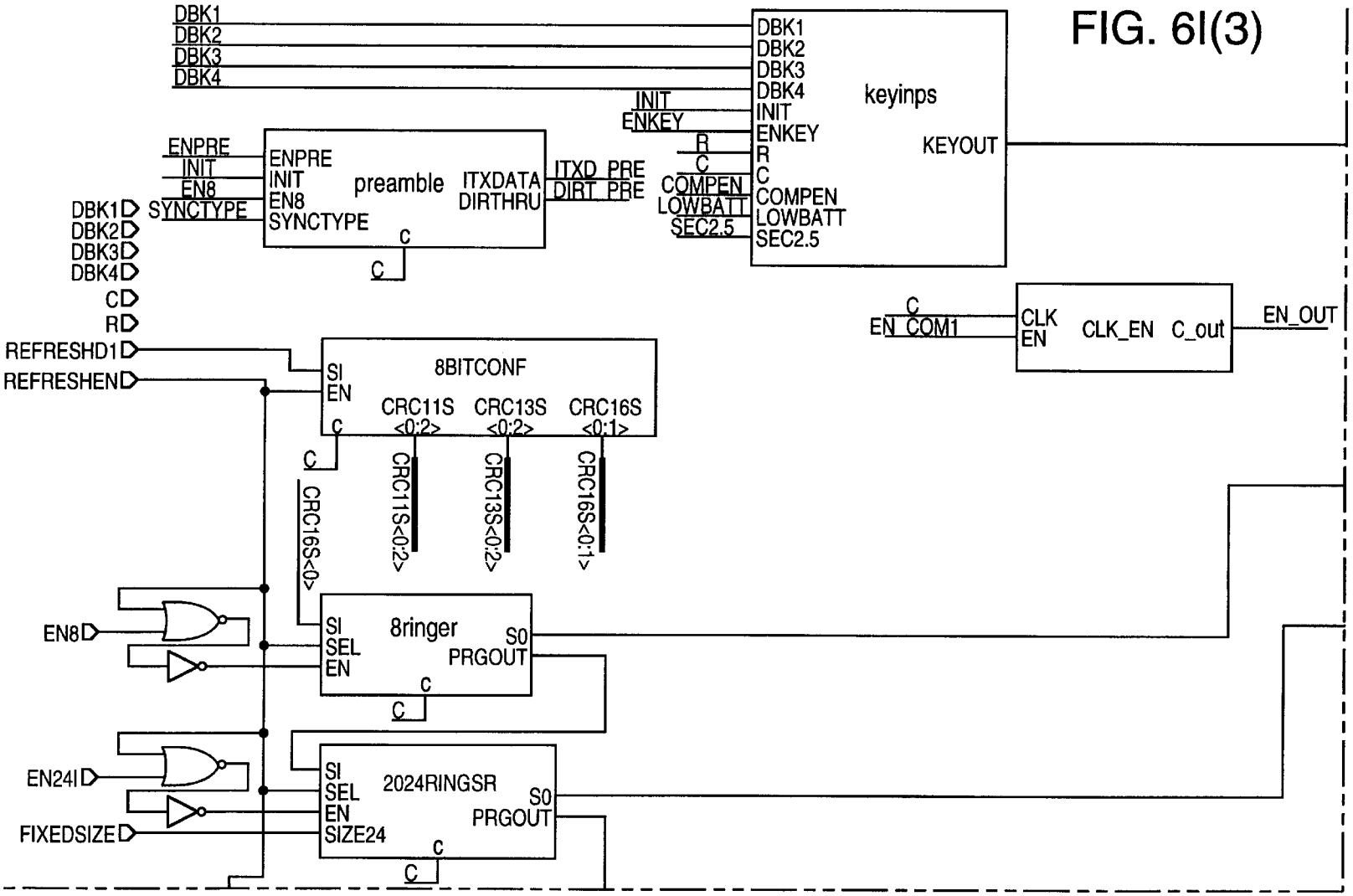
FIG. 6I(3)

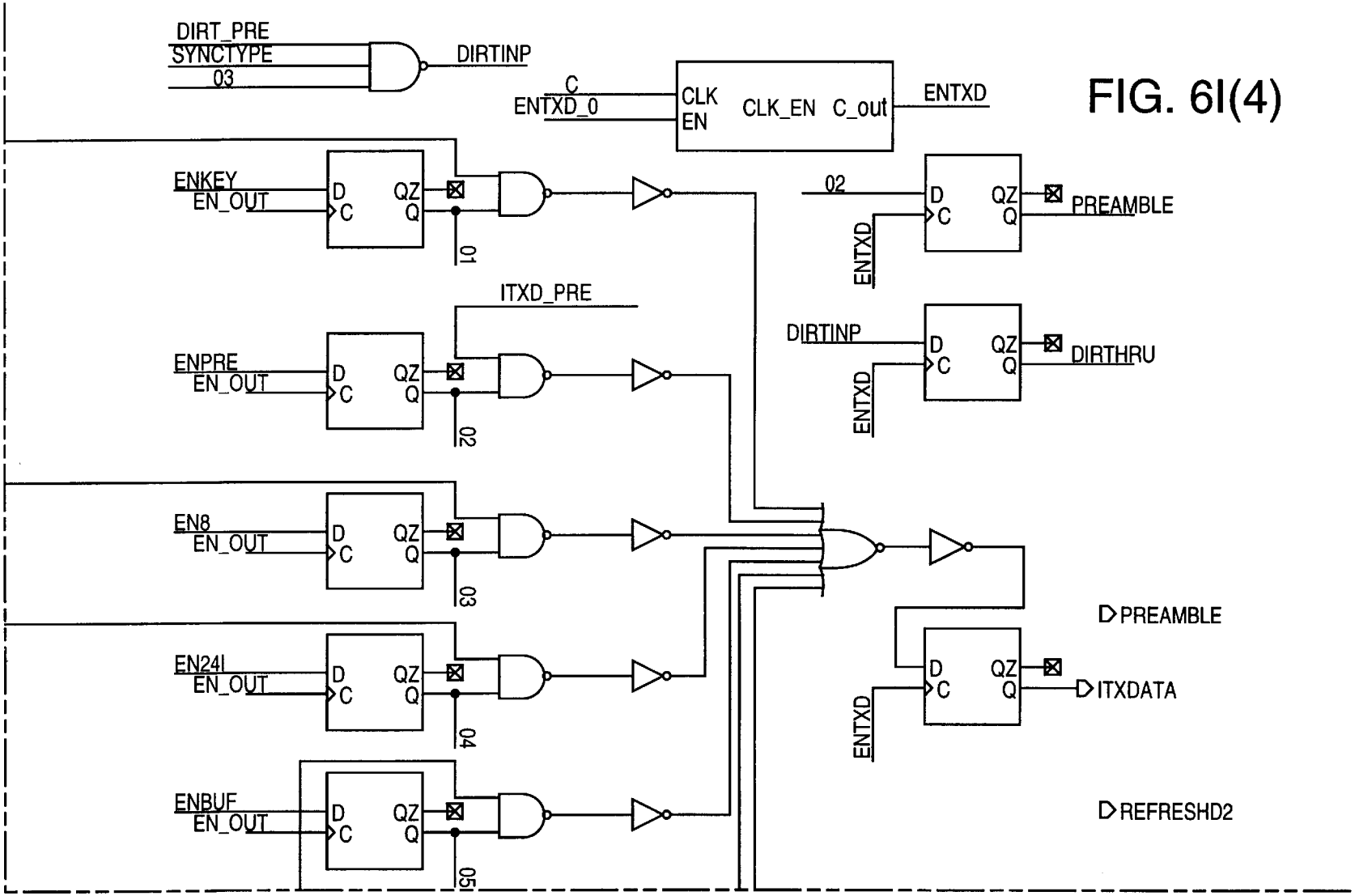
FIG. 6I(4)

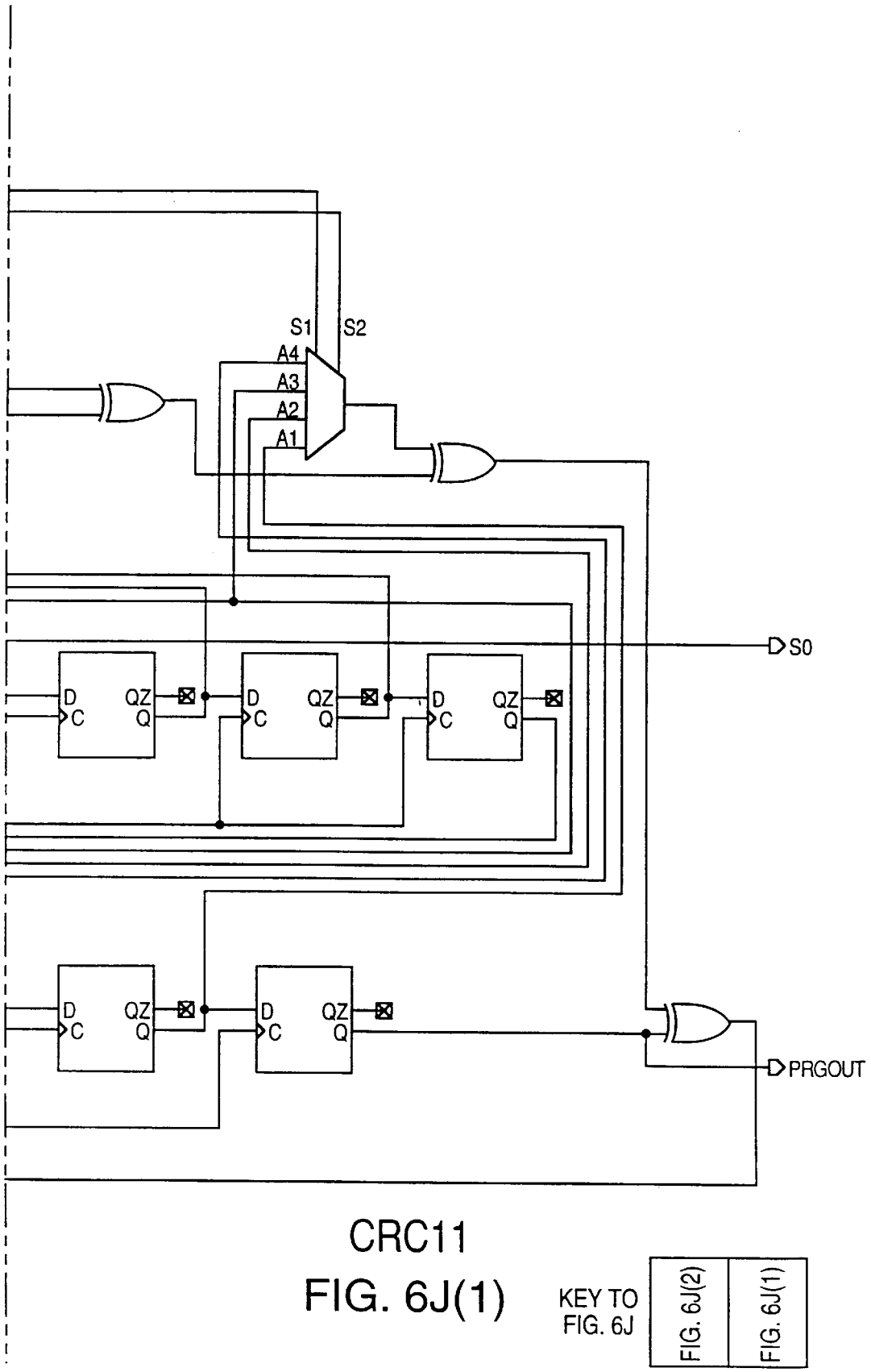
FIG. 6J(1)

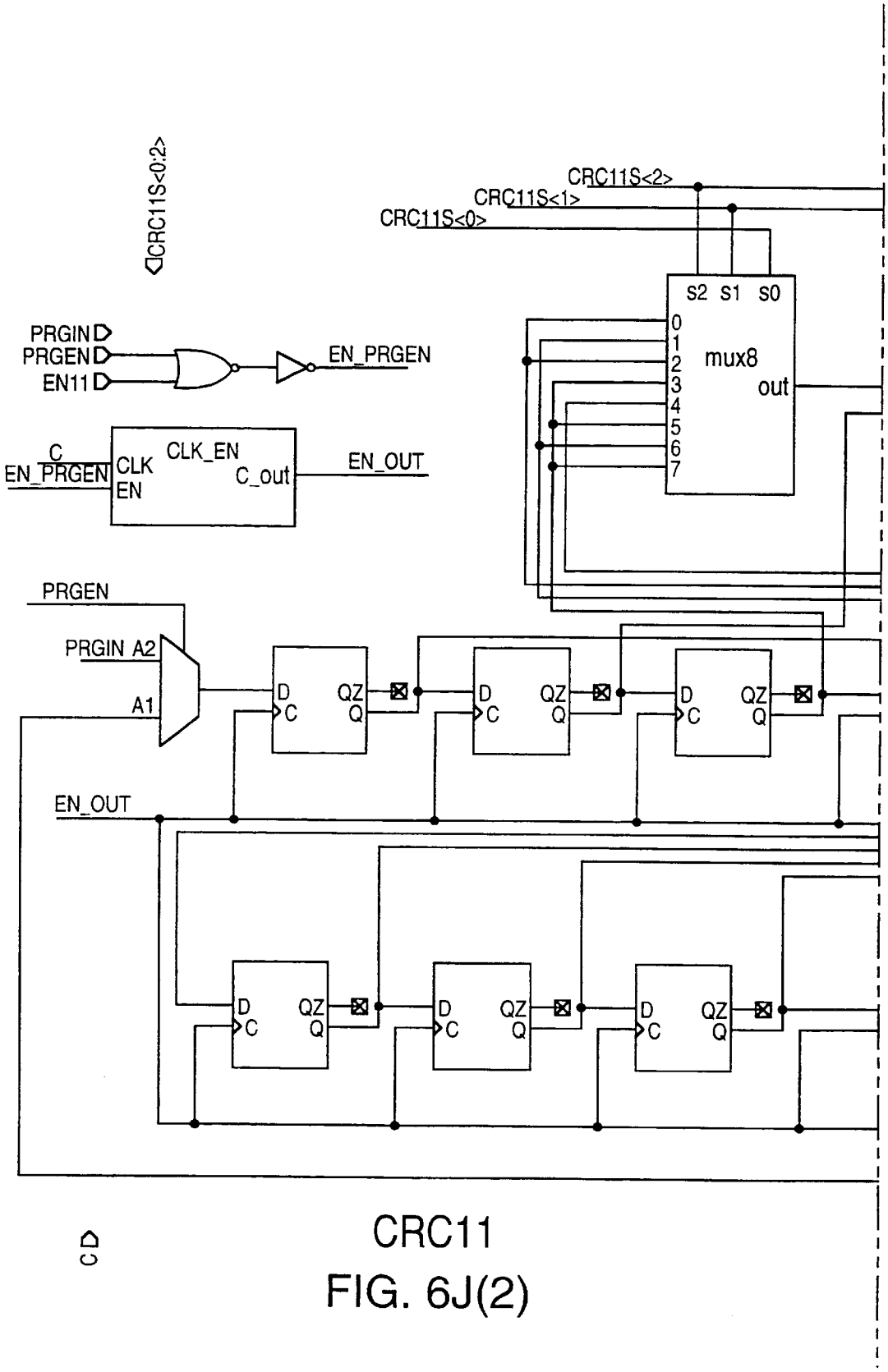
CRC11
FIG. 6J(2)

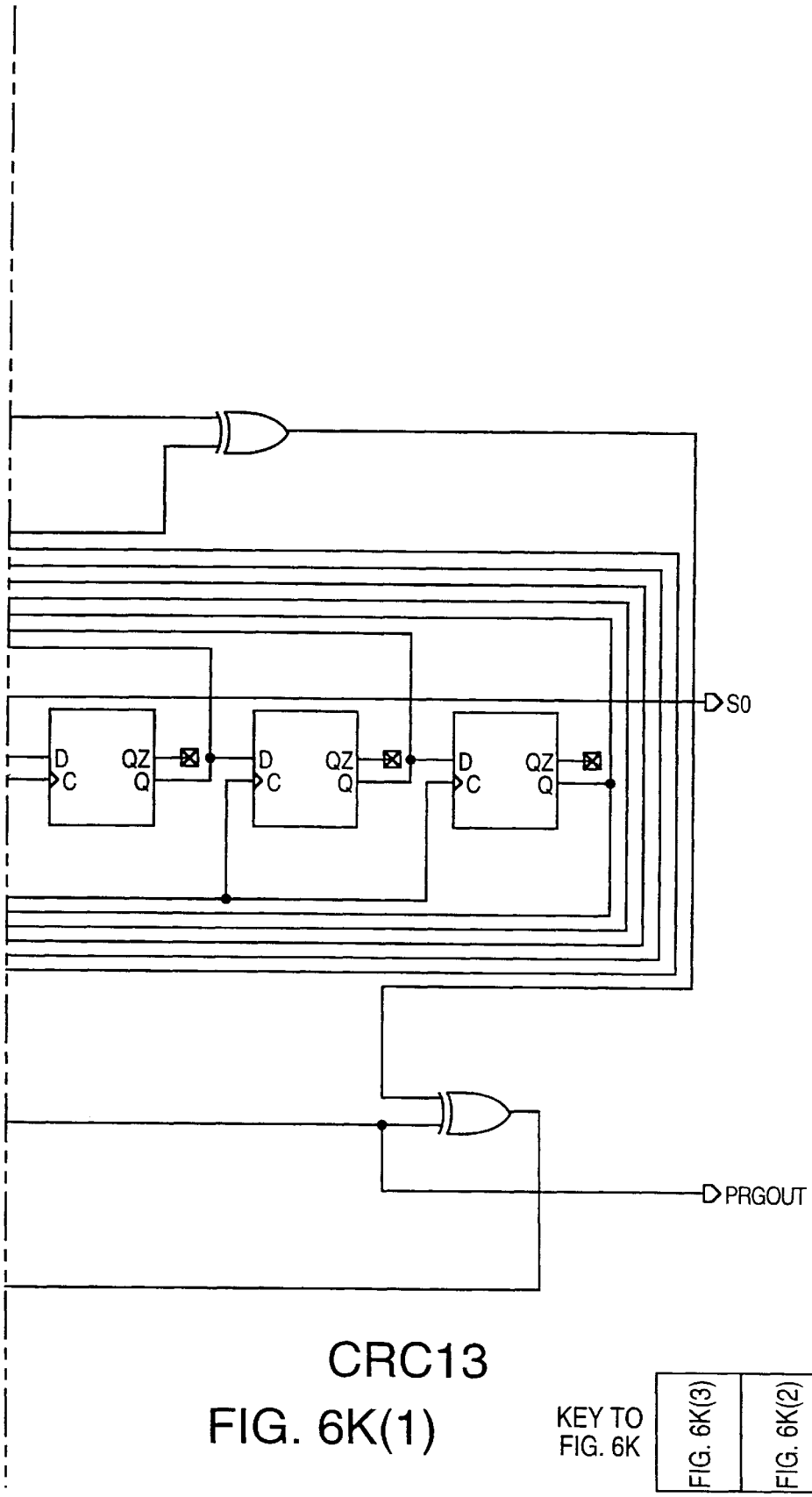
CRC13
FIG. 6K(1)
KEY TO FIG. 6K
| FIG. 6K(3) | FIG. 6K(2) | FIG. 6K(1) |
|---|---|---|

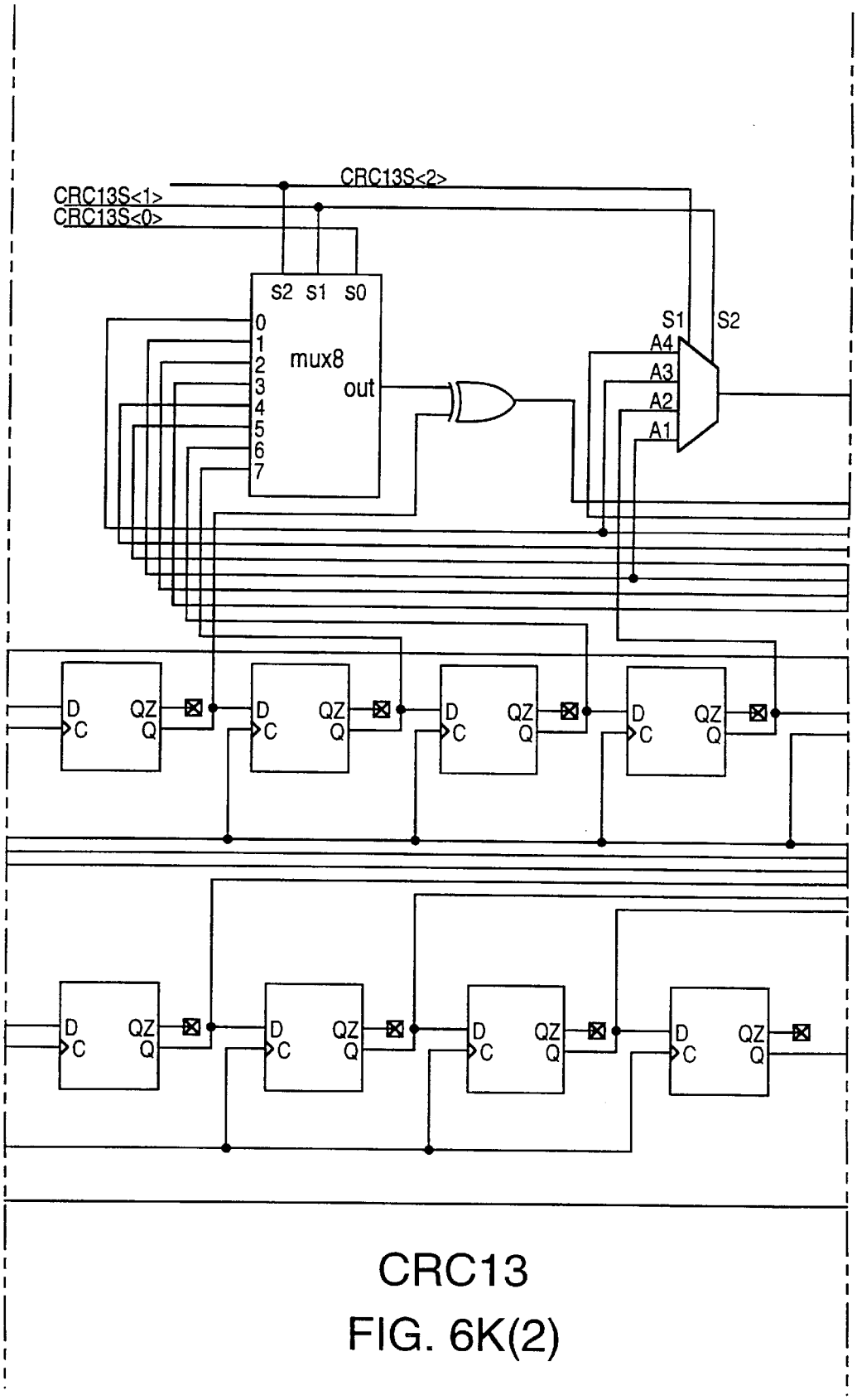
CRC13
FIG. 6K(2)

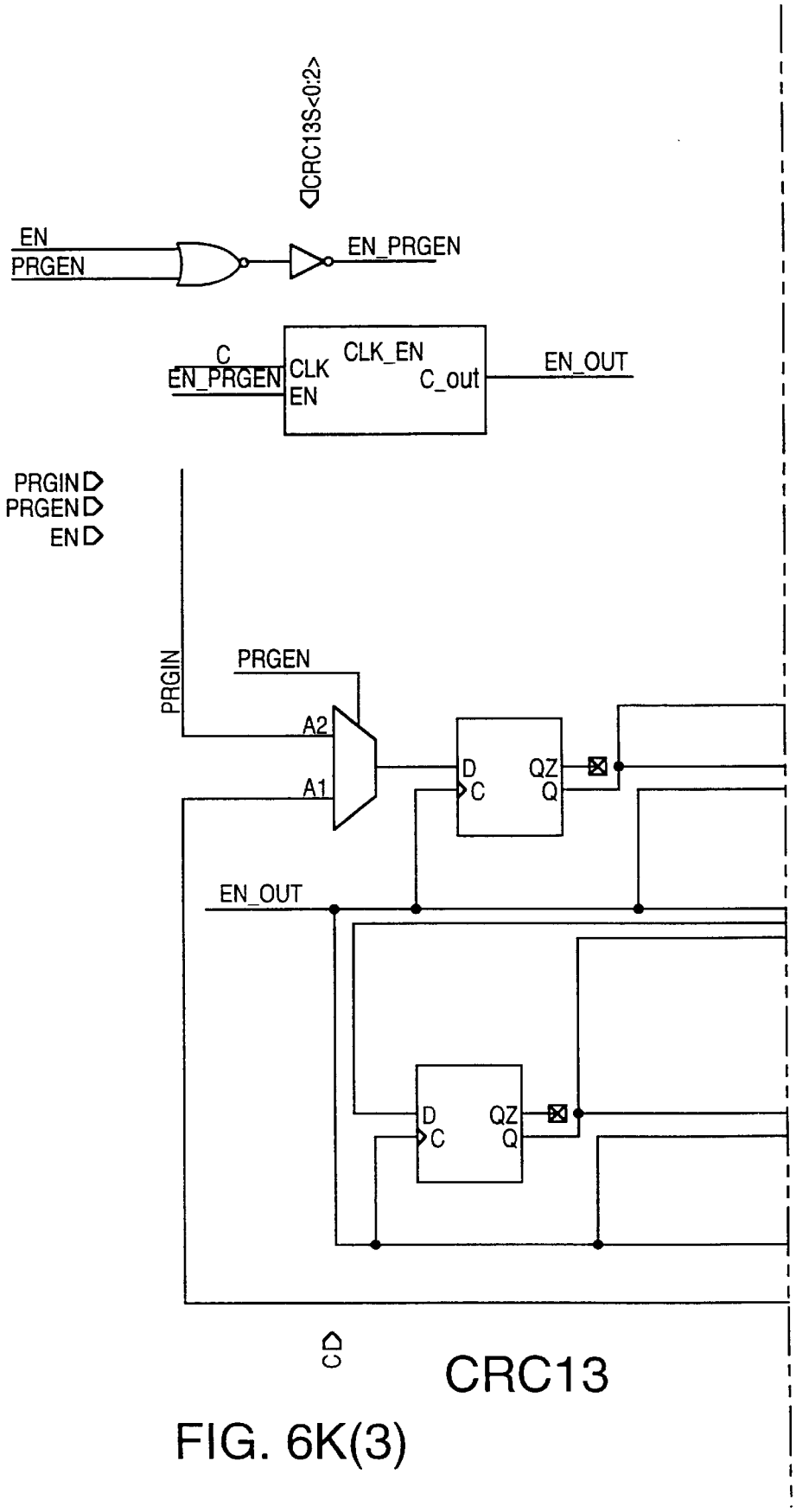
FIG. 6K(3)

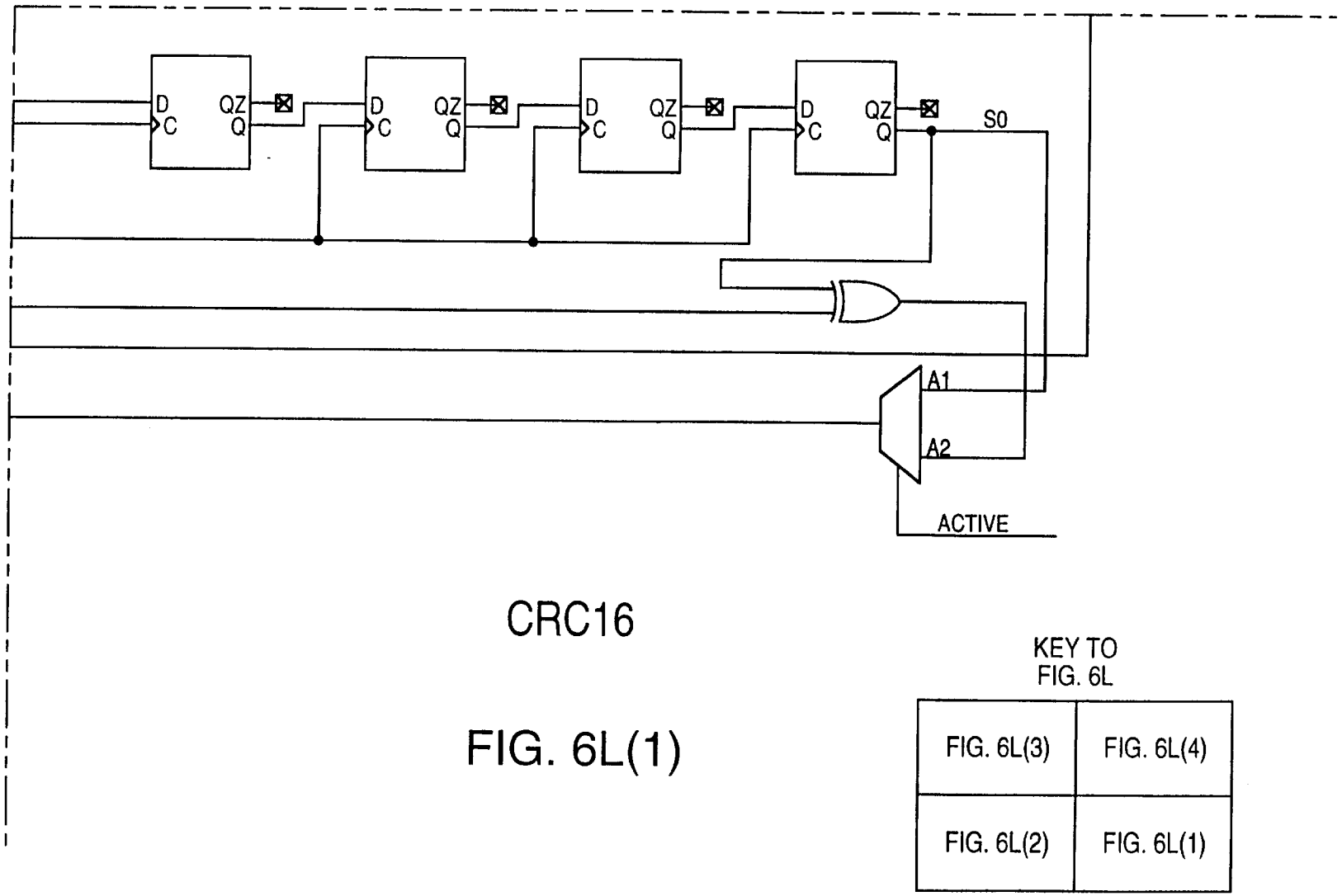
CRC16
FIG. 6L(1)

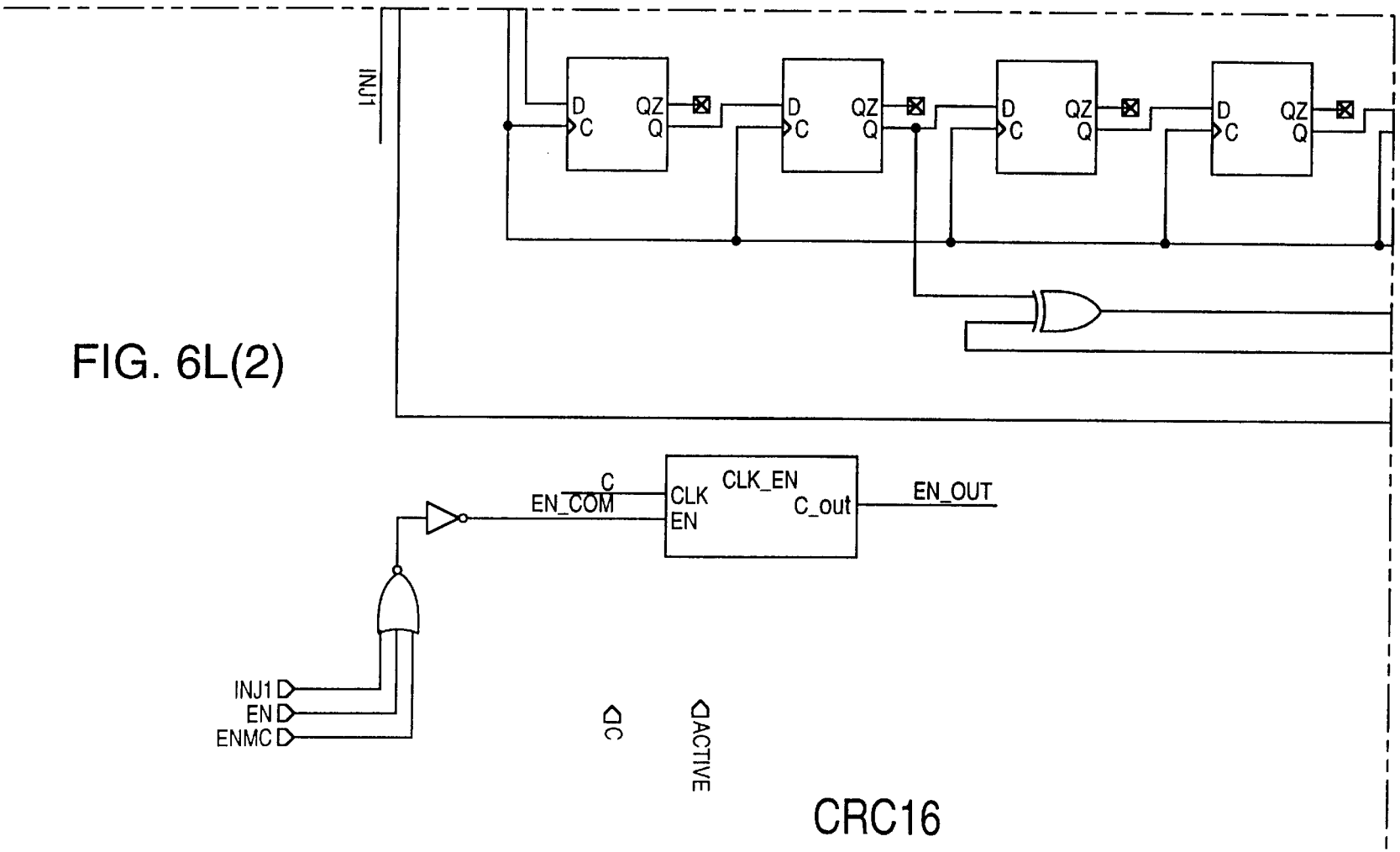
FIG. 6L(2)

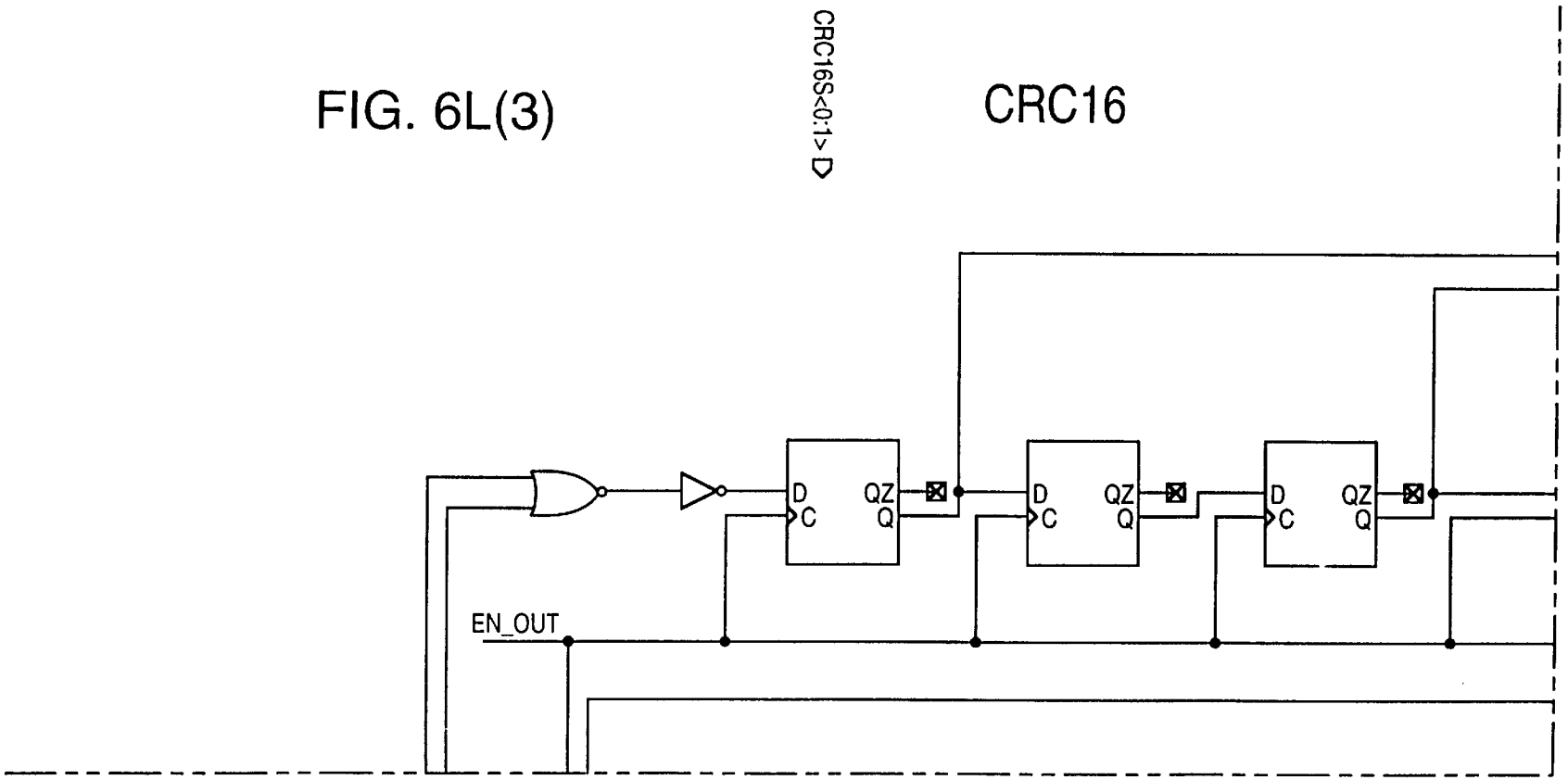
FIG. 6L(3)

FIG. 6L(4)
CRC16
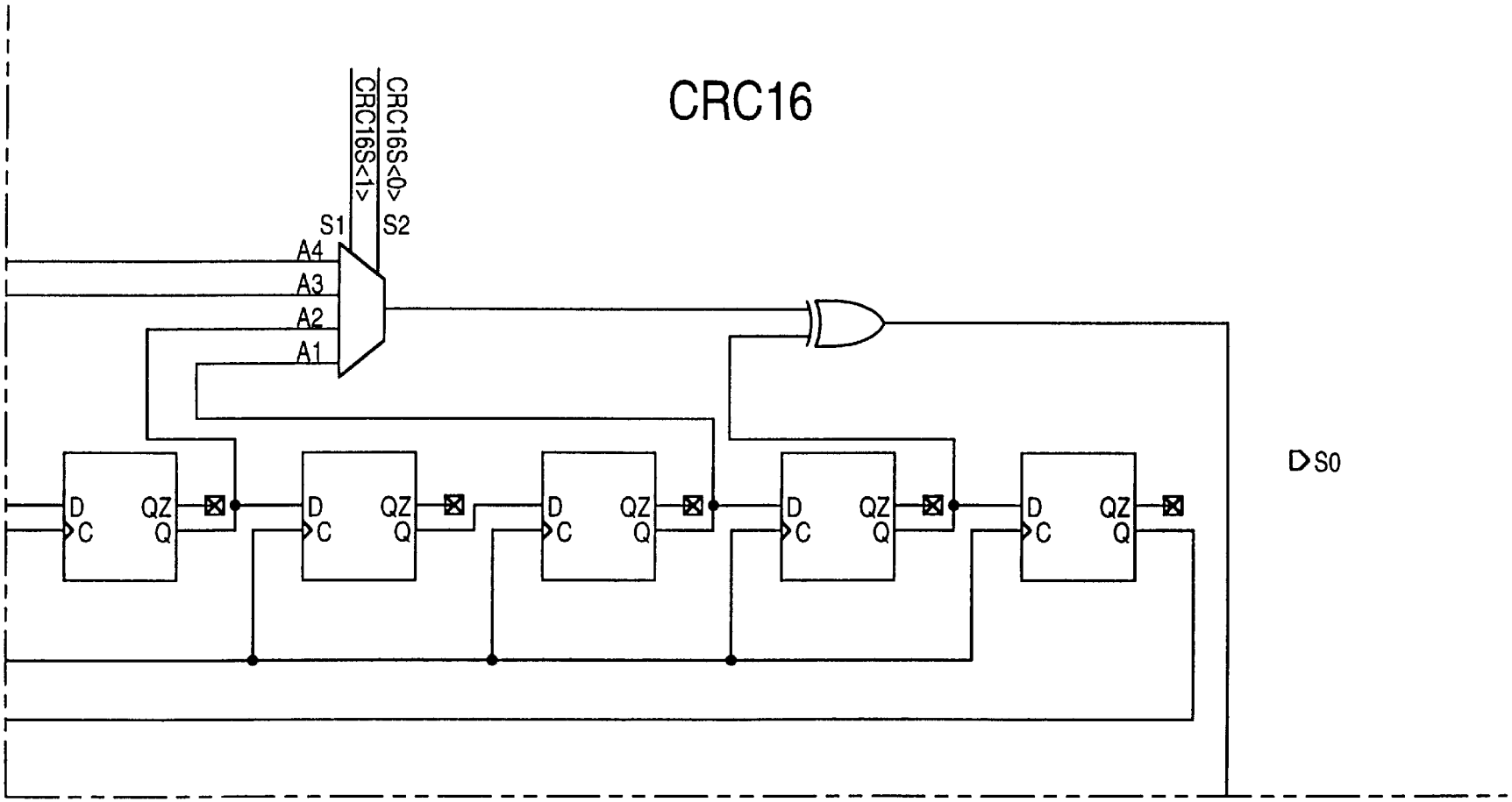

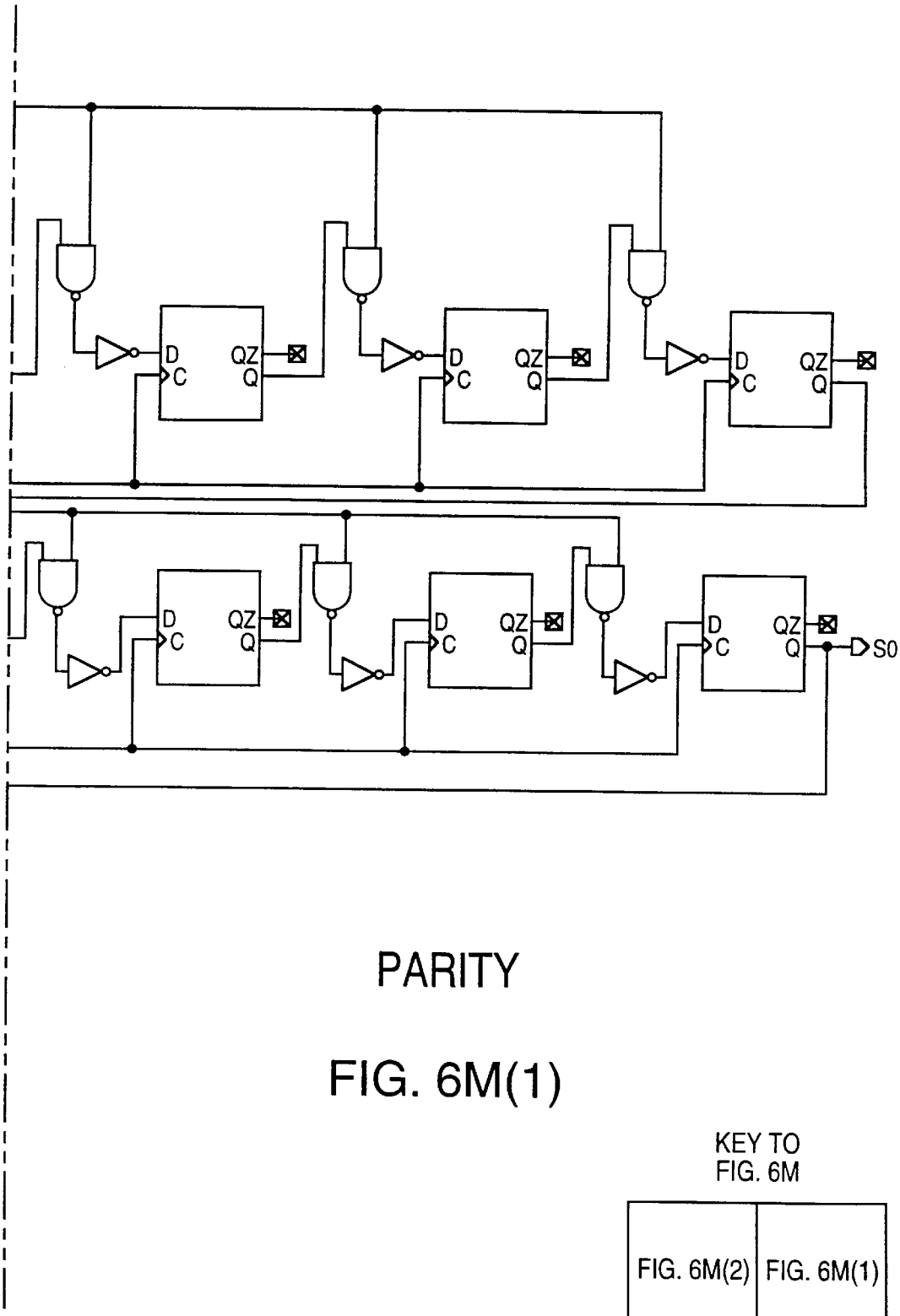
PARITY
FIG. 6M(1)
KEY TO FIG. 6M
| | |
|---|---|
| FIG. 6M(2) | FIG. 6M(1) |

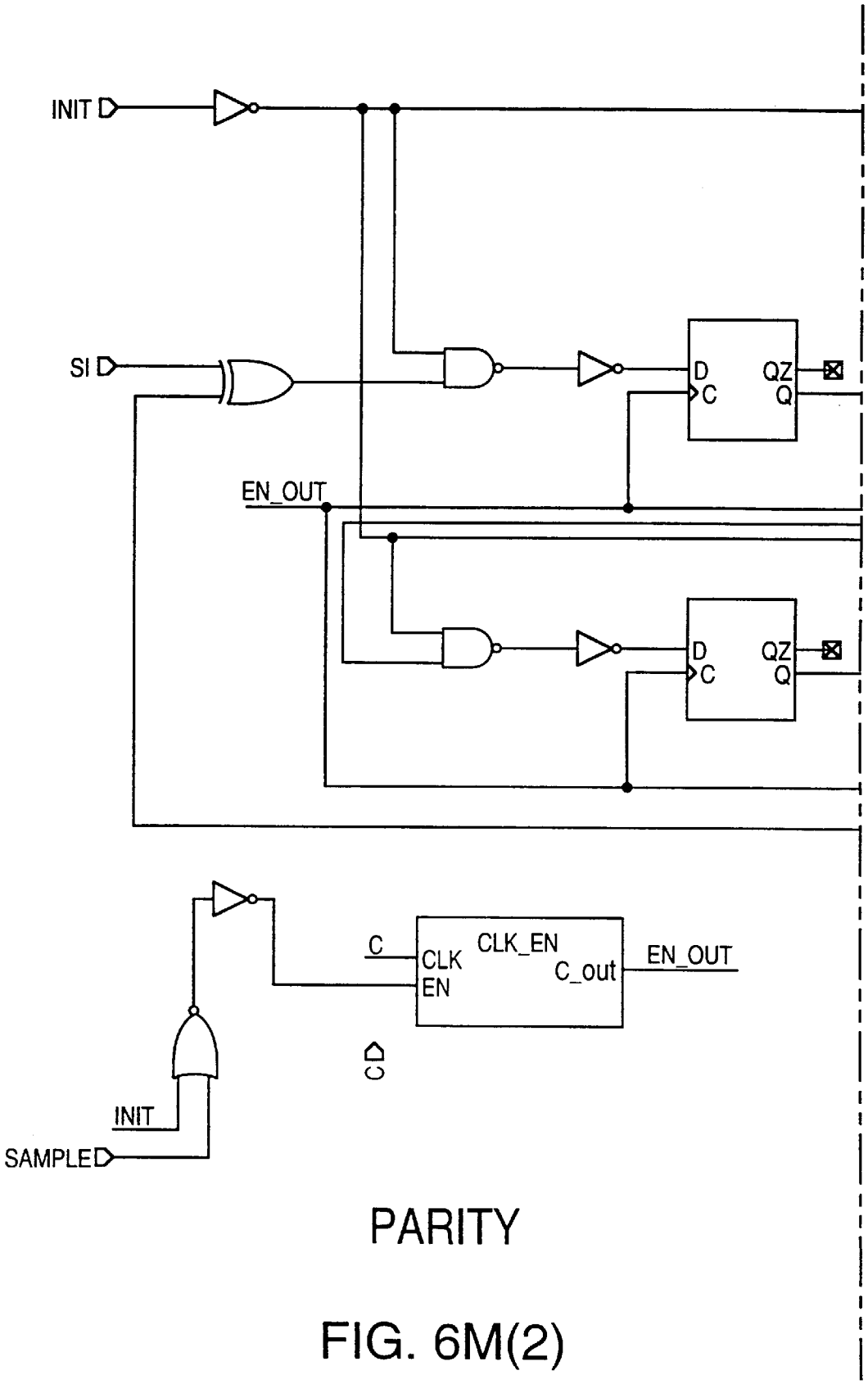
PARITY
FIG. 6M(2)

PREAMBLE

8BITCONF

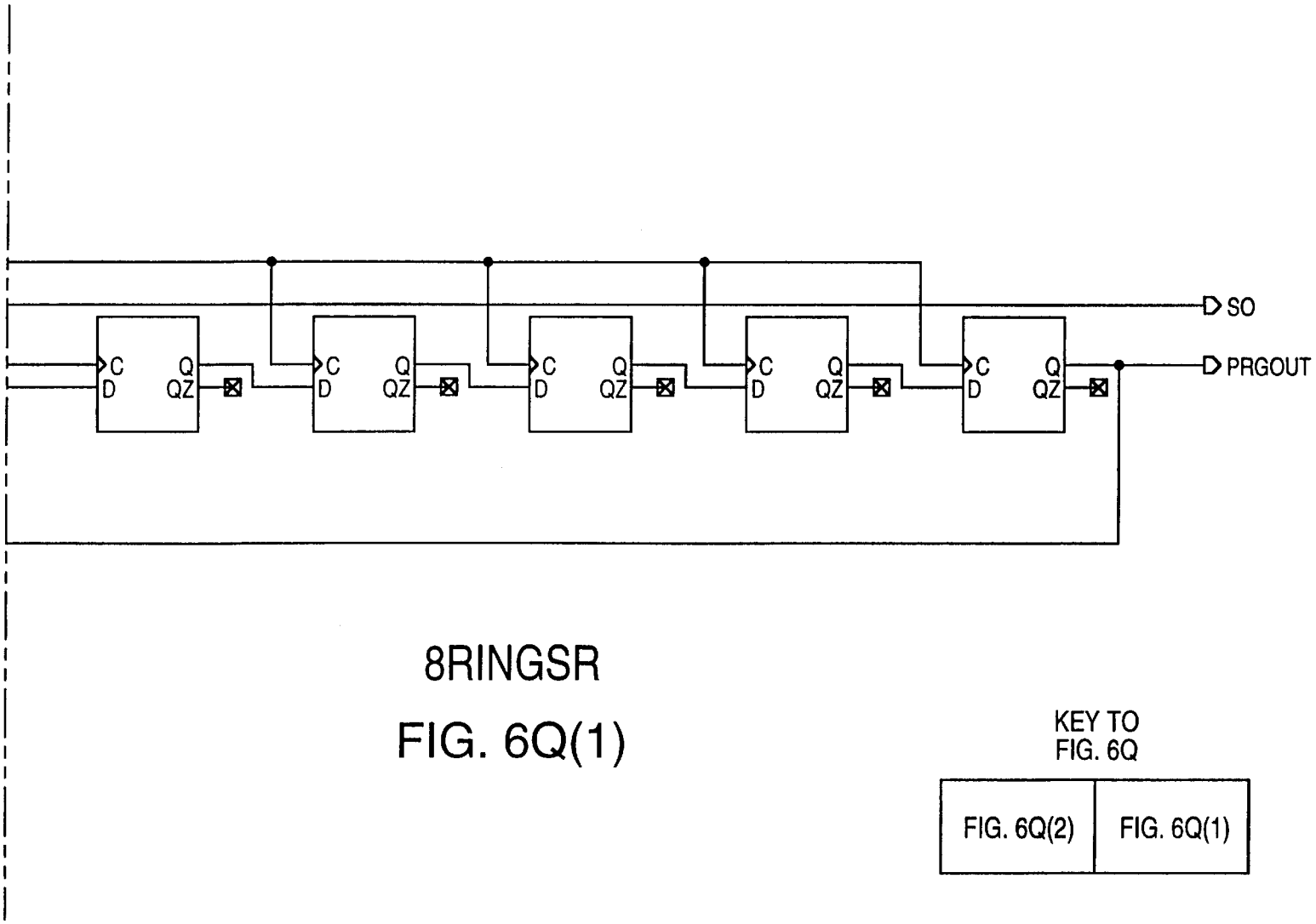
8RINGSR
FIG. 6Q(1)

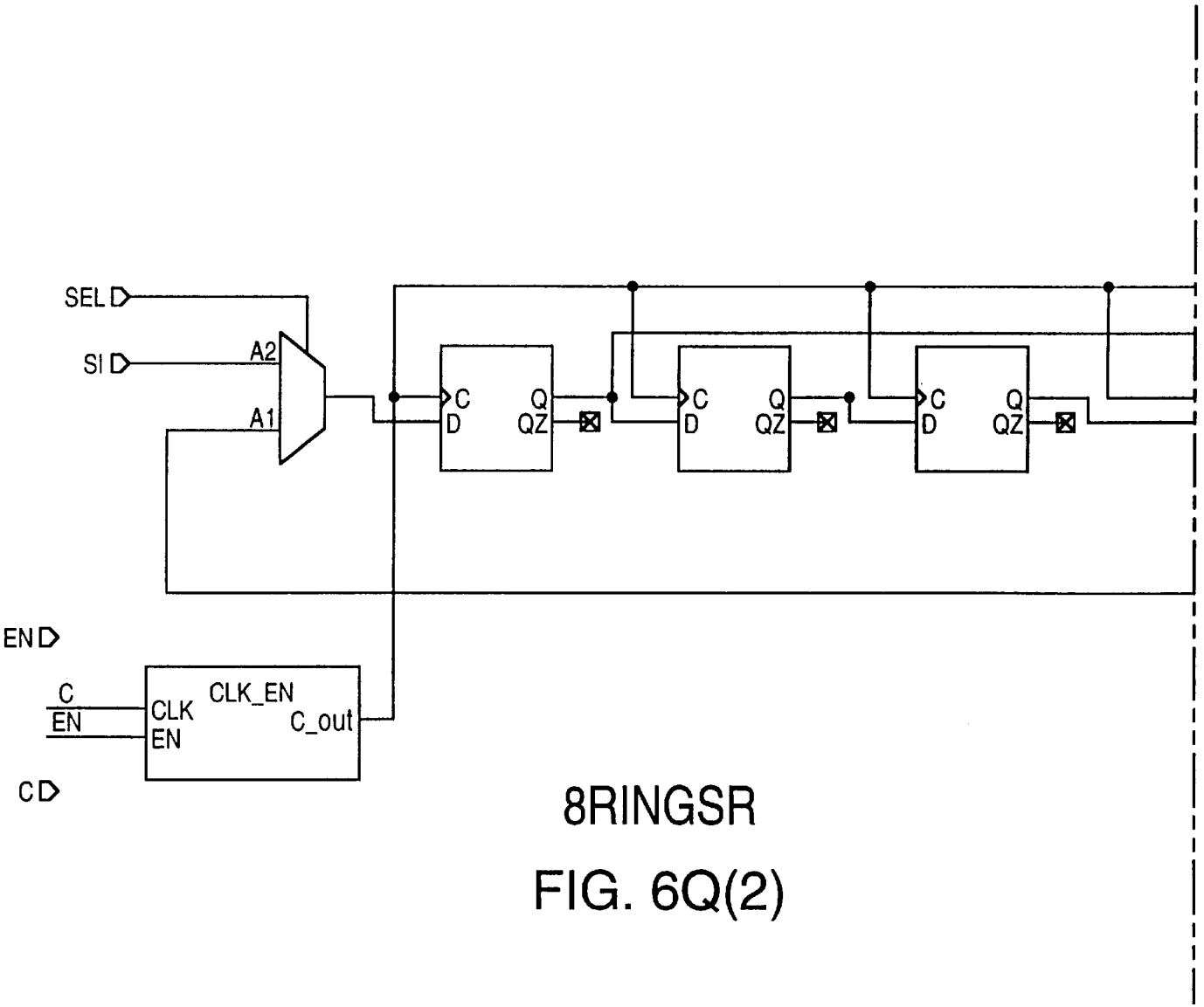
8RINGSR
FIG. 6Q(2)

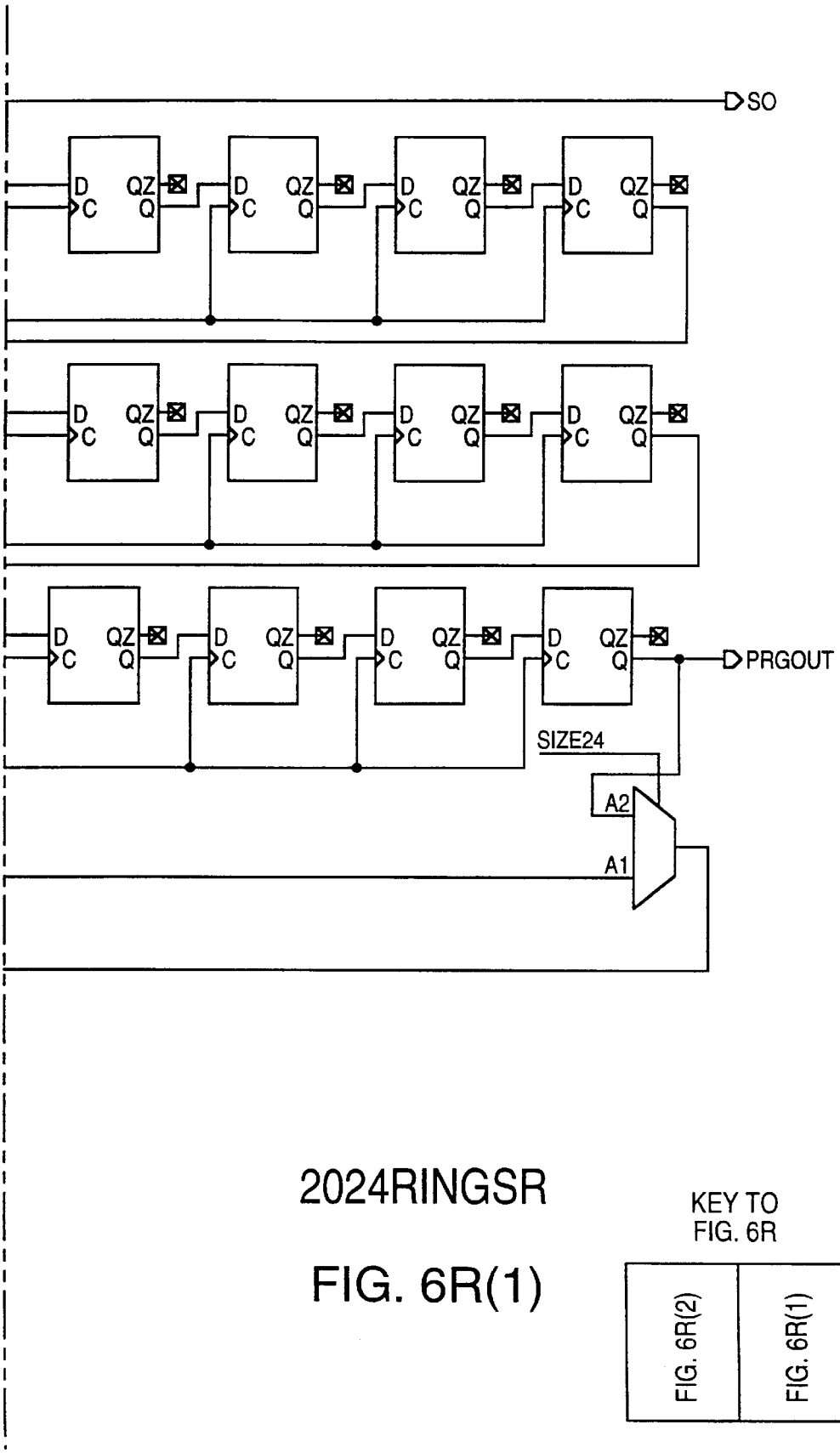
2024RINGSR
FIG. 6R(1)
KEY TO FIG. 6R
| FIG. 6R(2) | FIG. 6R(1) |
|---|---|

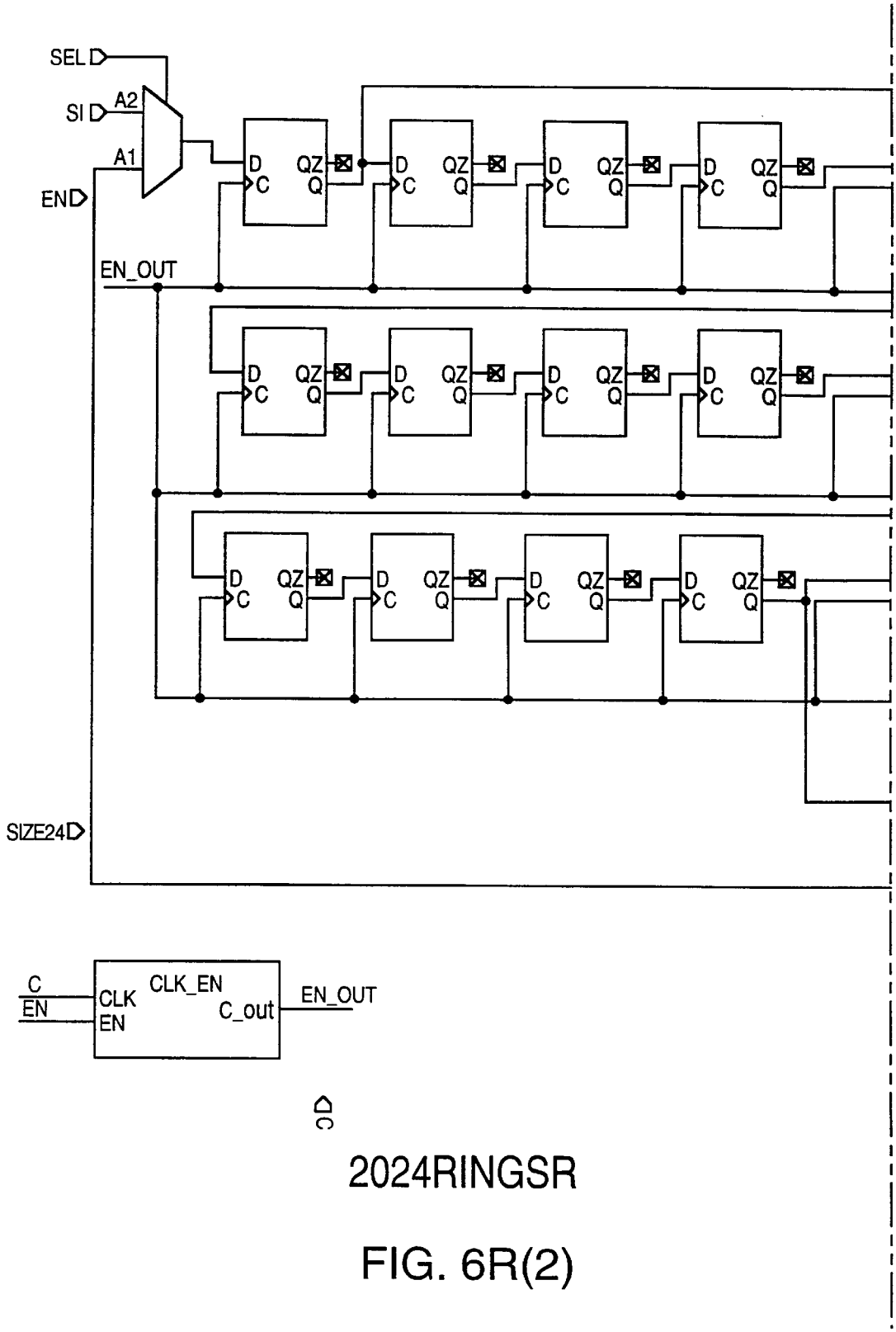
2024RINGSR
FIG. 6R(2)

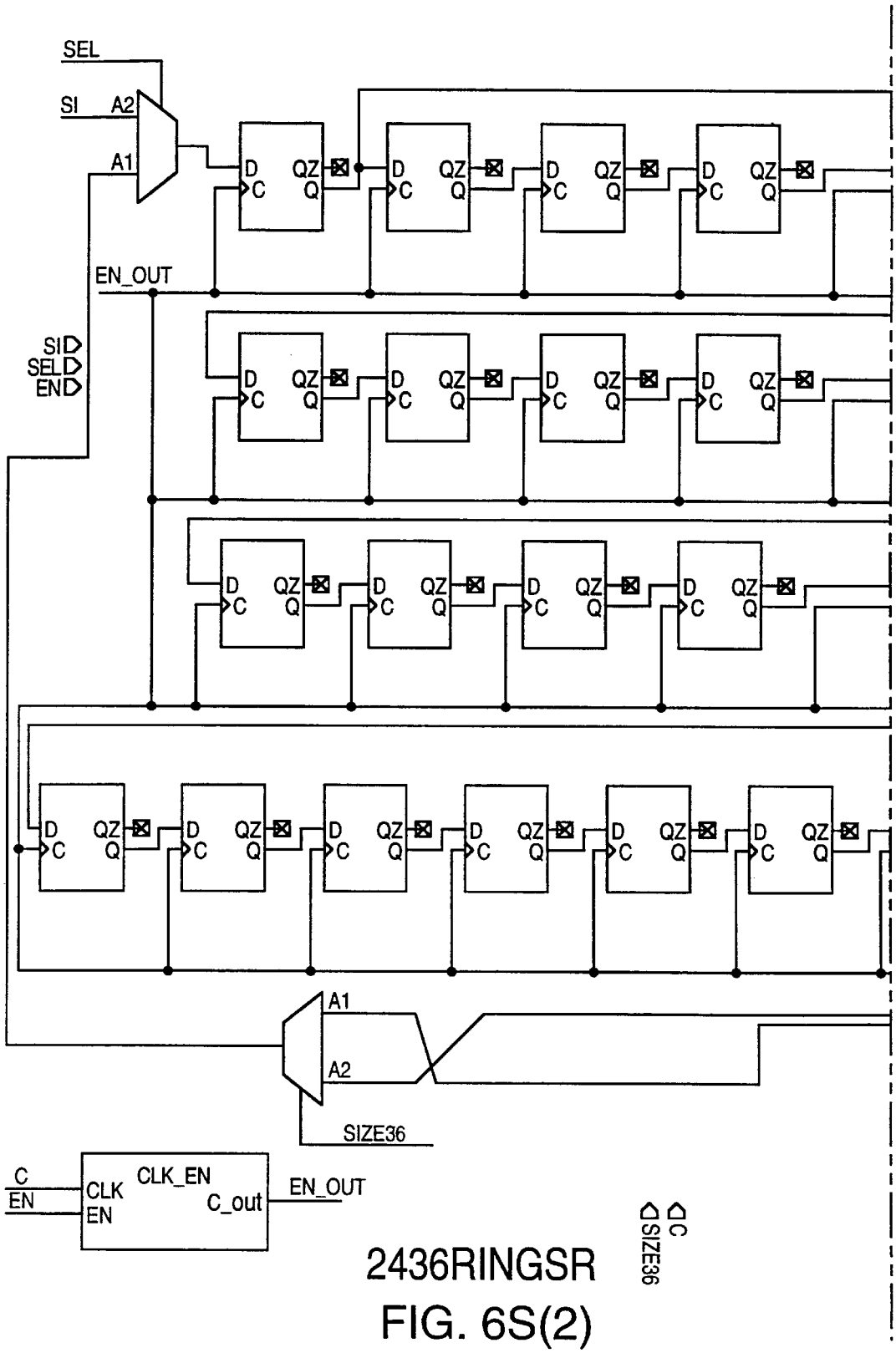
2436RINGSR
FIG. 6S(2)

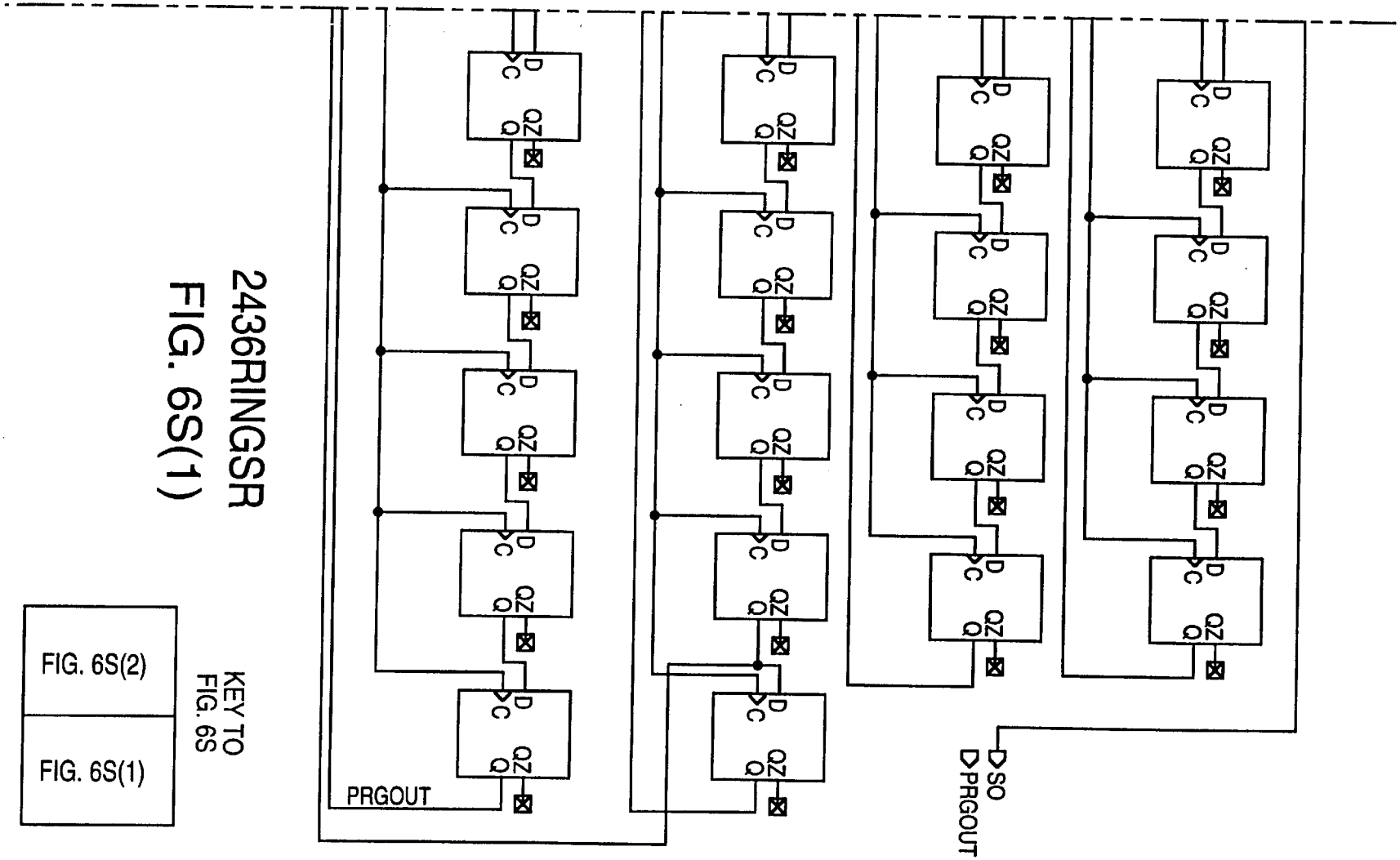
2436RINGSR
FIG. 6S(1)
KEY TO FIG. 6S

SECURITY SYSTEM WITH RANDOMIZED SYNCHRONIZATION CODE

This application is a continuation of application Ser. No. 08/145,471, filed Oct. 29, 1993 now U.S. Pat. No. 5,680, 131.

CROSS REFERENCE TO APPENDICES

Appendix A, which is a part of the present disclosure, includes 1 sheet of microfiche having a total of 28 frames. Appendix A is a specification for an integrated circuit embodiment of a transmitting unit.

Appendix B, which is a part of the present disclosure, includes 1 sheet of microfiche having a total of 69 frames. Appendix B is a hardware description language description of blocks of an integrated circuit in accordance with an embodiment of the present invention.

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The invention relates to wireless security systems. More particularly, the invention relates to a transmitting unit for a wireless security system for a vehicle, the transmitting unit generating and transmitting a different security code each time power is interrupted and re-supplied to the transmitting unit.

BACKGROUND INFORMATION

Remote control security systems are widely used in the automotive industry today. In addition to warning of an unauthorized entry into an automobile, such systems may allow the automobile owner to perform a variety of functions from a remote location, such as locking and unlocking the doors and trunk, raising and lowering the windows, starting the ignition, turning on and off the heat and air conditioning, and turning on and off headlights and interior lights.

Remote control security systems generally include a transmitting unit, which is portable, and a receiving unit, which is attached to the automobile. A binary verification code may be stored in both the transmitting unit and in the receiving unit. When a user presses a pushbutton on the transmitting unit, the verification code stored in the transmitting unit is transmitted as a series of pulses to the receiving unit. The receiving unit, upon receipt of transmission, compares the incoming verification code with a verification code stored in the receiving unit. If the verification code received from the transmitting unit matches the verification code stored in the receiving unit, then the receiving unit enables a function (for example unlocking the doors) to be performed. The function is dictated by a function code which is transmitted by the transmitting unit along with the verification code.

A drawback with the above described remote control security system is the ease of unauthorized entry into the automobile. With the proliferation of code copying devices, such as universal remote control units designed for combining into one remote control unit all the codes required to operate home entertainment systems, it has become possible to copy verification codes of automobile security systems. A universal remote control unit may receive a transmission from an original remote control unit of a television remote, for example, and may memorize that transmission so that the universal remote control unit can later retransmit the transmission to the television in the place of the original television remote.

In response to this problem, remote control security systems have been developed which use different verification codes on successive transmissions. These remote control security systems may include a counter in the transmitting unit and a corresponding counter in the receiving unit. The verification code may have two portions: the value output by the counter in the transmitting unit and a fixed system identification value. When the user presses the pushbutton on the transmitting unit, the value output by the counter in the transmitting unit is incremented and a verification code is transmitted incorporating both the new counter value and the fixed system identification value. The receiving unit, after receiving the incoming transmission, compares a fixed system identification value stored in the receiving unit with the fixed system identification value received. If the fixed system identification values match, then the counter in the receiving unit is incremented and the output of the incremented counter in the receiving unit is compared with the counter value received. The counter values of the counter in the transmitting unit and the counter in the receiving unit should therefore match each other on successive transmissions if the fixed system identification code transmitted and the fixed system identification code stored in the receiving unit match. Due to the operation of the counters, a thief's copying of a verification code of a given transmission will not enable the thief to gain entry to the automobile by retransmitting the verification code because the receiving unit expects a different verification code for the next transmission. The counter may be a pseudo-random number generator to make deciphering the next counter value more difficult if the present counter value is known.

Although conventional remote control security systems which use incrementing counter values in conjunction with verification codes are generally more secure than systems which always transmit the same verification code, car thieves may still be able to gain unauthorized entry into automobiles due to an inherent weakness of these conventional systems. When power is disconnected and then resupplied to the transmitting unit of one of these security systems (for example, by removing and then reinserting the battery), the counter of the transmitting unit typically restarts at an initial count value. Accordingly, the first verification code after the battery is removed and re-inserted is always the same, the second verification code after the battery is removed and re-installed is always the same, and so on. This predictability has lead to a risk of unauthorized access.

Consider the following valet parking scenario. When parking an automobile equipped with such a remote control security system, the valet parking attendant is given custody of the transmitting unit of the security system along with the mechanical keys to the automobile. If the valet is in possession of a code copying device, the valet may obtain access to the automobile at some time in the future when the automobile is no longer in the custody of the parking attendant and when thievery is not directly traceable to the attendant. First, the valet removes and re-inserts the battery in the transmitting unit, thus resetting the counter to its initial value. Second, the valet repeatedly presses the button on the transmitting unit and uses a code copier to copy the next certain number (for example fifty) of verification codes. Third, the valet then once again removes and re-inserts the battery to reset the counter in the transmitting unit back to its initial value. Fourth, the valet resynchronizes the receiving unit to the reset transmitting unit.

Now in possession of the next certain number (for example fifty) of successive verification codes of the security system, the valet may be able to locate the automobile on the street after the automobile has left valet custody and to transmit the successive verification codes stored in the code copier. If the car owner has only used the transmitting unit a small number of times (for example, less than fifty) since the verification codes were copied, then the verification code expected by the receiving unit will be one of the (fifty) verification codes in the possession of the thief. The thief may therefore be able to gain access to the automobile by transmitting successive verification codes until the correct verification code opens the car.

SUMMARY

A transmitting unit of a wireless security system generates randomized successive verification codes ("rolling verification codes"). In some embodiments, a pseudo-random number generator in the transmitting unit is used to generate a randomized synchronization code after power up which is transmitted to a receiving unit. The receiving unit uses information in the synchronization code to initialize a corresponding pseudo-random number generator in the receiving unit. The first verification code transmitted from the transmitting unit is generated by incrementing the transmitted pseudo-random number generator and encrypting and combining the output of the pseudo-random number generator with other information in accordance with a particular method. The receiving unit, in order to test the validity of the verification code received, increments its pseudo-random number generator and generates a corresponding "reference code" in accordance with the method used by the transmitting unit. If the reference code matches the verification code, then the transmission is deemed a valid verification code. Successive verification codes are generated by successively incrementing the transmitting unit's pseudo-random number generator.

The transmitting unit transmits a different synchronization code ("randomized synchronization code") each time that the transmitting unit is powered up. In an embodiment, a pseudo-random number generator generates a sequence of pseudo-random values throughout a period of time from when power is supplied to the transmitting unit until a manually-operable switch on the transmitting unit is depressed. The pseudo-random value output by the pseudo-random number generator when depression of the switch causes the pseudo-random number generator to stop is incorporated into the synchronization code transmitted after the first power up. In another embodiment, a pseudo-random number generator in the transmitting unit generates a sequence of pseudo-random values during a period of time the manually-operable switch is depressed.

In either embodiment, if power to the transmitting unit is interrupted and then resupplied (for example by removing and then replacing a battery of the transmitting unit), then the pseudo-random number generator will again generate a sequence of pseudo-random values. In one embodiment, the pseudo-random number generator starts incrementing after the battery is replaced and stops incrementing when the manually-operable switch is depressed. In another embodiment, the pseudo-random number generator starts incrementing when the manually-operable switch is depressed and stops incrementing when the manually-operable switch is released. In either case, however, the new pseudo-random value is incorporated into the next synchronization code. Accordingly, a thief will not be able to reset the transmitting unit to output the same sequence of verification codes by removing and replacing the battery of a transmitting unit. In certain embodiments, a key identifier code specific to the transmitting unit is included in messages so that the receiving unit does not have to test the validity of the verification code or to resynchronize if the received key identifier code does not match the key identifier code of the particular transmitting unit with which the receiving unit is programmed to operate.

BRIEF DESCRIPTION OF THE DRAWINGS

The present invention can be more fully understood by reference to the following detailed description and accompanying drawings, which form an integral part of the application:

FIGS. 3, and 3A–3D are flow charts illustrating an operation of the transmitting and receiving units in accordance with an embodiment of the present invention.

FIG. 4A illustrates a message containing a synchronization code in accordance with the present invention.

FIG. 4B illustrates a message containing a verification code in accordance with the present invention.

DETAILED DESCRIPTION OF THE PREFERRED EMBODIMENTS

Figure 1:
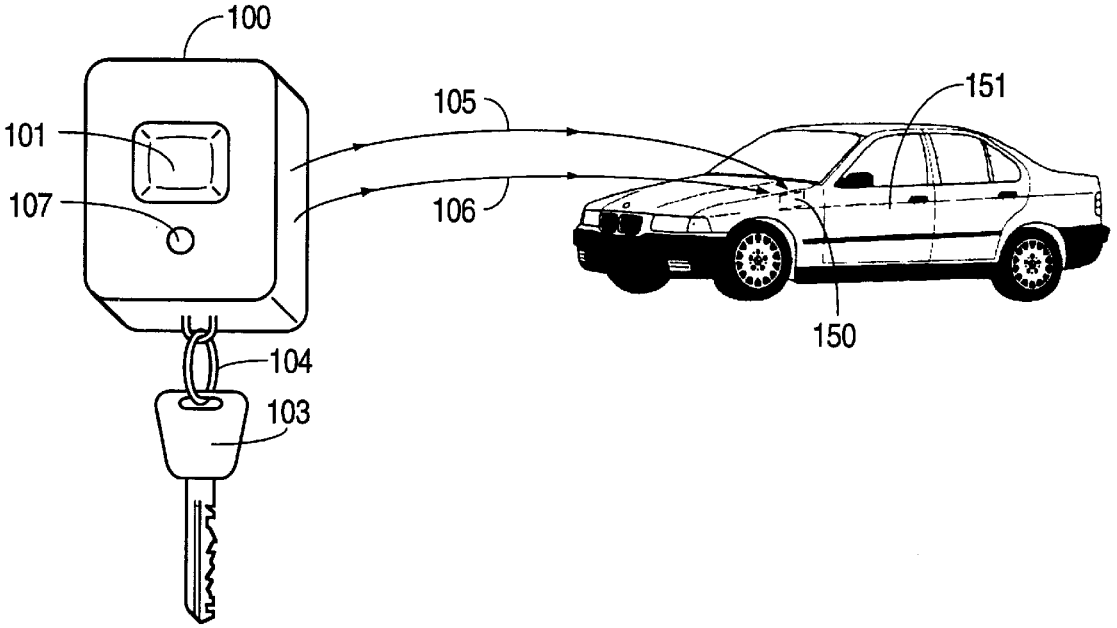
FIG. 1 is a pictorial view of a transmitting unit communicating with a receiving unit in a vehicle in accordance with an embodiment of the present invention.

FIG. 1 is a pictorial view illustrating a transmitting unit 100 having a pushbutton switch 101 and a light emitting diode (LED) indicator 107 in accordance with an embodiment of the present invention. A mechanical key 103 such as an automobile key is shown attached to the transmitting unit 100 via a metal ring 104.

In FIG. 1, transmitting unit 100 is shown transmitting a first message 105 and a second message 106 to a receiving unit 100 of a vehicle 151. First message 105 contains a synchronization code. The receiving unit 150 uses the synchronization code contained in the first message to synchronize itself to the transmitting unit. The second message 106 contains both a verification code and a function code. The receiving unit 150 uses the verification code contained in the second message 106 to determine whether message 106 was generated from an authorized transmitting unit. If the second message is determined to have been generated by an authorized transmitting unit, then the receiving unit 150 enables the function indicated by the function code of the second message 106.

Figure 2:
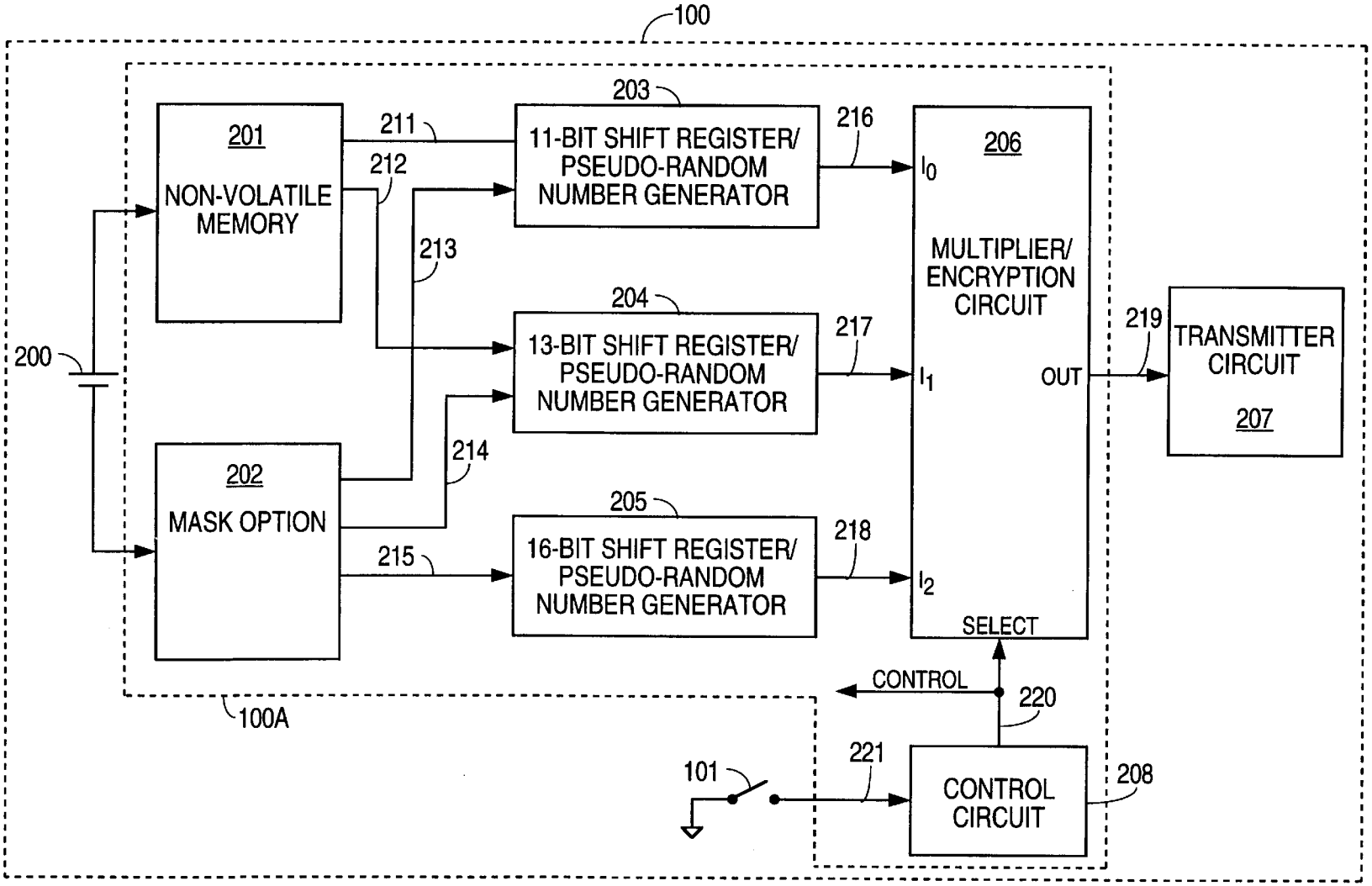
FIG. 2 is a simplified block diagram of a transmitting unit in accordance with an embodiment of the present invention.

FIG. 2 is a simplified block diagram of transmitting unit 100 in accordance with an embodiment of the present invention. Transmitting unit 100 includes a battery 200, a non-volatile memory 201, a mask option 202, an 11-bit ring shift register/pseudo-random number generator circuit (RS/PRNG circuit) 203, a 13-bit RS/PRNG circuit 204, a 16-bit RS/PRNG circuit 205, a multiplexer/encryption circuit 206, a transmitter circuit 207, a control circuit 208, and manually-operable pushbutton switch 101. Dashed line 100A encloses a portion of circuitry which may, for example, be realized in integrated circuit form.

Manually-operable pushbutton switch 101 is coupled via lead 221 to control circuit 208 such that an activation signal is asserted (at a digital logic level 0) onto an input lead of control circuit 208 when pushbutton 101 is depressed. Depressing pushbutton 101 causes a falling high-to-low transition whereas releasing pushbutton 101 causes a rising low-to-high transition.

Each of RS/PRNG circuits 203, 204 and 205 is controllable to operate either as a ring shift register or as a pseudo-random number generator. The particular sequence of pseudo-random values generated by each of the three RS/PRNG circuits is determined by a hardwired mask option value received from mask option block 202. A first control input lead of 11-bit RS/PRNG circuit, a first control input lead of 13-bit RS/PRNG circuit 204 and a first control input lead of 16-bit RS/PRNG circuit 205 are coupled to mask option 202 via leads 213, 214 and 215, respectively.

Mask option 202 outputs an 8-bit predetermined value. The first three bits of the predetermined value define the polynomial by which the 11-bit RS/PRNG circuit 203 operates, the second three bits define the polynomial by which the 13-bit RS/PRNG circuit 204 operates, and the last two bits define the polynomial by which the 16-bit RS/PRNG circuit 205 operates. Thus, each of the 11-bit and 13-bit RS/PRNG circuits 203–204 may operate according to one out of eight possible polynomials, and the 16-bit RS/PRNG circuit 205 may operate according to one out of four possible polynomials.

Nonvolatile memory 201 may, in some embodiments, involve an electrically erasable read only memory (EEPROM) and may store a start value which is loaded in serial fashion into 11-bit RS/PRNG 203 and a start value which is loaded in serial fashion into 13-bit RS/PRNG 204. A second input lead of 11-bit RS/PRNG circuit 203 is coupled to non-volatile memory 201 and a second input lead of 13-bit RS/PRNG circuit 204 is coupled to non-volatile memory 201 by leads 211 and 212, respectively.

Multiplexer/encryption circuit 206 can either operate as a multiplexer or as an encryption circuit. An output lead of 11-bit RS/PRNG circuit 203 is coupled to a first input lead of multiplexer/encryption circuit 206, an output lead of 13-bit RS/PRNG circuit 204 is coupled to a second input lead of multiplexer/encryption circuit 206, and an output lead of 16-bit RS/PRNG circuit 205 is coupled to third input lead of multiplexer/encryption circuit 206 via leads 216, 217 and 218, respectively.

Control circuit 208, although only explicitly shown controlling a select input lead of multiplexer/encryption circuit 206 via lead 220, also controls others of the blocks of FIG. 2 via other leads which are omitted from FIG. 2 for clarity of illustration. Control circuit 208 may be realized as one or more sequential state machines. Control circuit 208 also includes a switch debounce circuit to debounce the activation signal on lead 221, a power-on reset circuit, and an oscillator/prescaler circuit for generating the clock signals necessary to generate the control signals to control various ones of the other blocks. RS/PRNG circuits 203, 204 and 205, for example, receive clock signals from the control circuit 208 which are not illustrated in the simplified block diagram and also receive configuration control signals which determine whether the RS/PRNG circuits operate as ring shift registers or as pseudo-random number generators. Multiplexer/encryption circuit 206 also receives a configuration control signal which determines whether multiplexer/encryption circuit 206 operates as a multiplexer or as an encryption circuit.

Battery 200 provides power to the circuitry of all the blocks of the transmitting unit 100 and is therefore illustrated having arrows extending from its terminals.

Transmitter circuit 207 may, for example, be a radio frequency transmitter circuit or may be an infrared transmitter circuit. An input lead of transmitter circuit 207 is coupled to an output lead of multiplexer/encryption circuit 206 via lead 219.

Figure 3A:
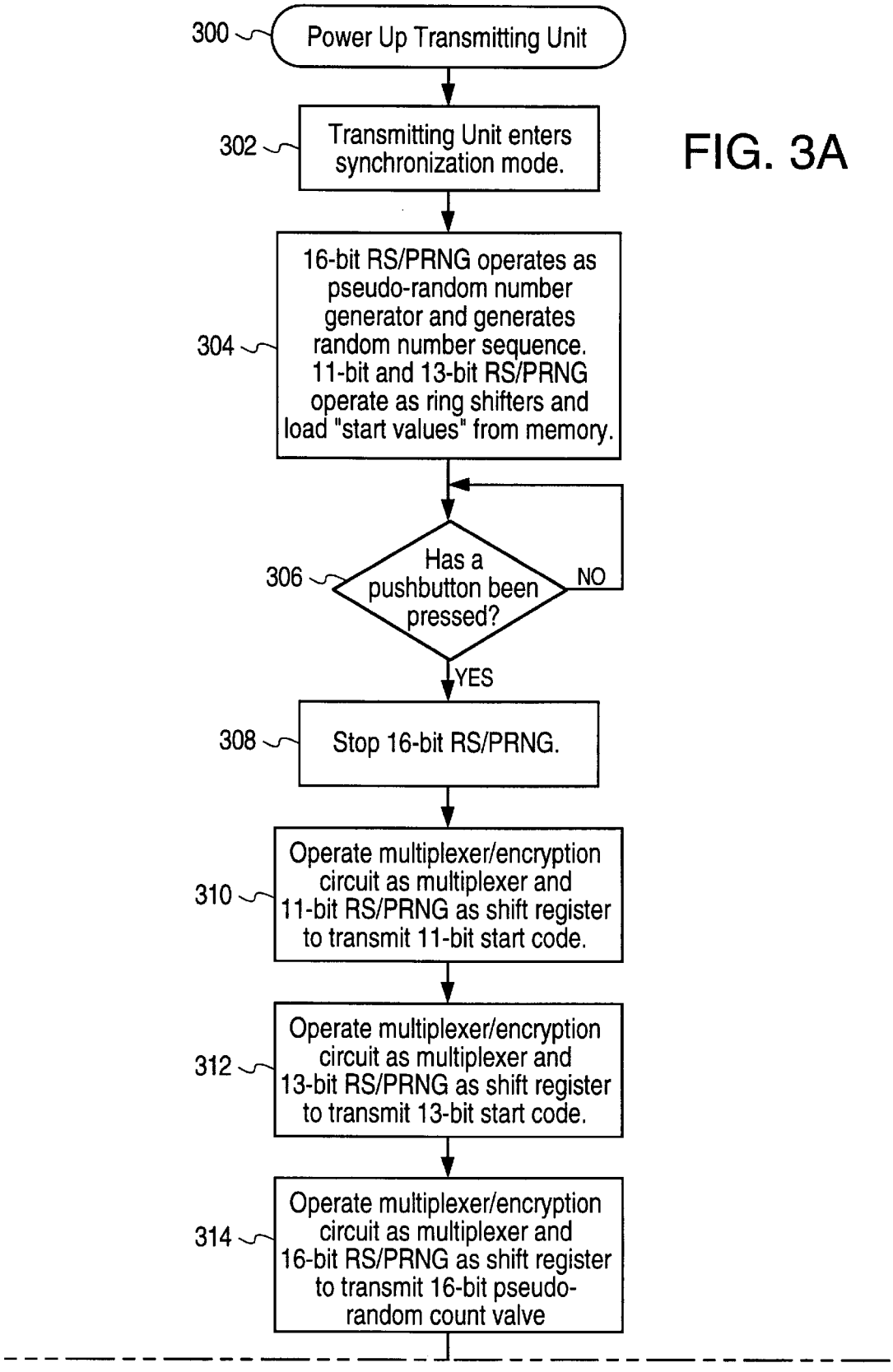
Figure 3B:
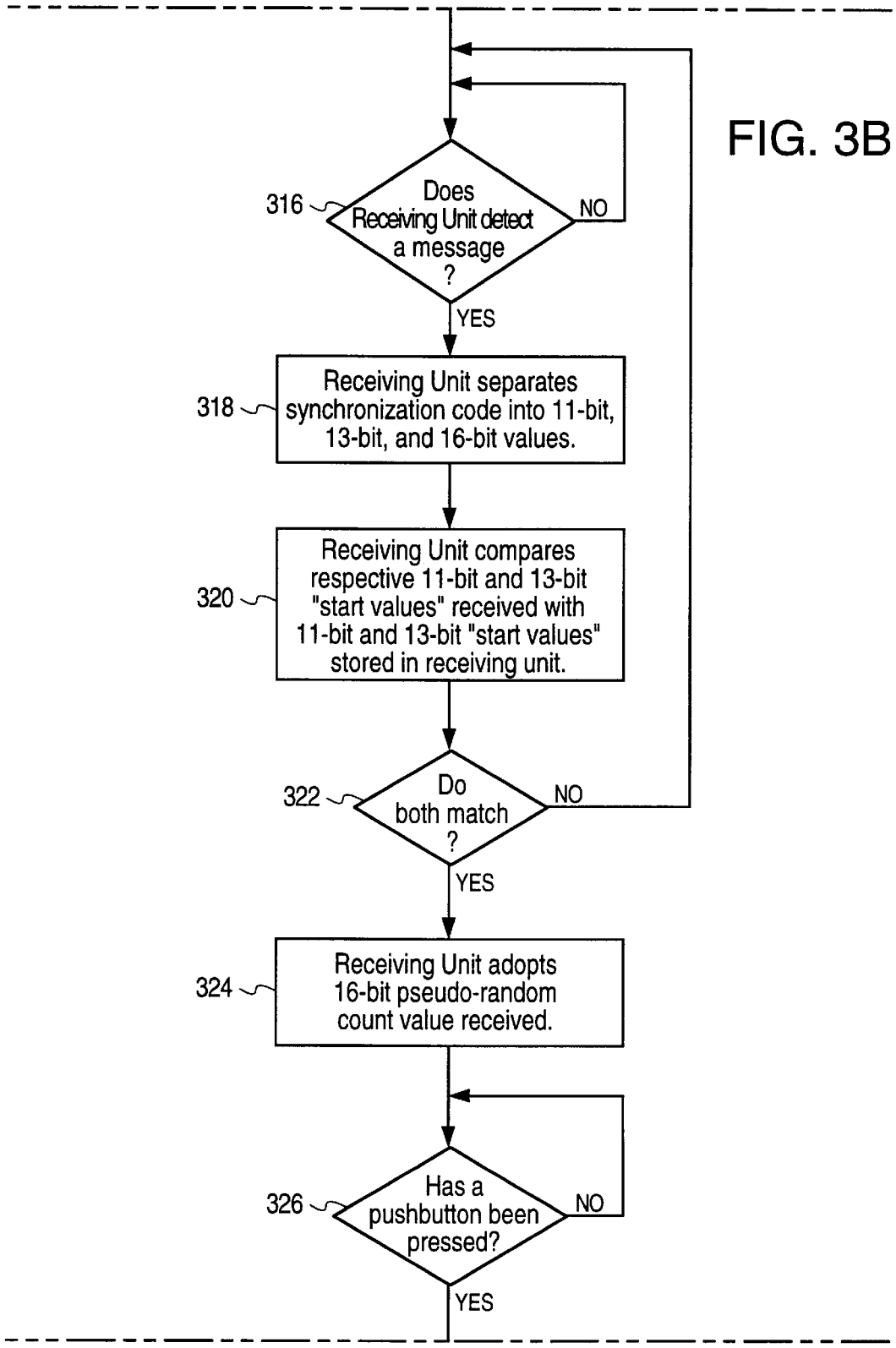
Figure 3C:
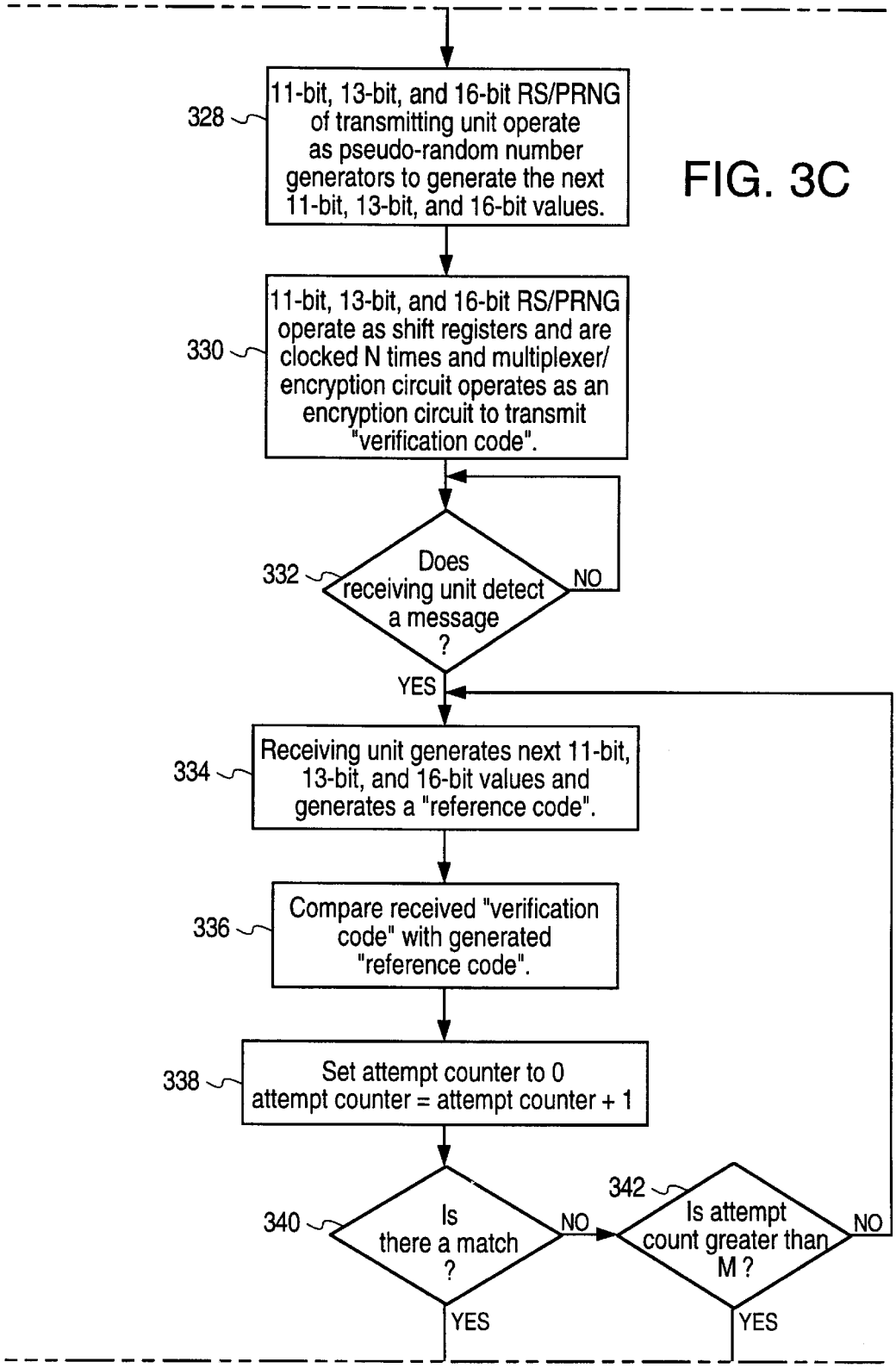

FIG. 3 is a simplified flow chart illustrating an operation of a vehicle security system in accordance with an embodiment of the present invention. When power is first applied (step 300) to transmitting unit 100, transmitting unit 100 enters a "synchronization mode" (step 302). 16-bit RS/PRNG circuit 205 begins operating as a pseudo-random number generator and generates a pseudo-random sequence of 16-bit binary values (step 304). 11-bit RS/PRNG circuit 203 operates as a ring shift register rather than as a pseudo-random number generator so that an 11-bit "start value" stored in non-volatile memory 201 is shifted into 11-bit RS/PRNG circuit 203 (step 304). Similarly, 13-bit RS/PRNG circuit 203 operates as a ring shift register rather than as a pseudo-random number generator so that an 13-bit "start value" stored in non-volatile memory 201 is shifted into 11-bit RS/PRNG circuit 203 (step 304).

The start value (including the bits of both "start values" described above) is generally programmed to be specific to the particular transmitting unit. One of two bits of the start value may, however, be common to multiple transmitting units. All automobiles of a given make may, for example, have common bits in a sub-field of the start value which are unique to that given make.

When pushbutton switch 101 is depressed a first time (step 306), 16-bit RS/PRNG circuit 205 stops generating successive 16-bit values and holds the last 16-bit value generated when pushbutton 101 was depressed (step 308). Control circuit 208 clocks the 11-bit RS/PRNG circuit 203, controls 11-bit RS/PRNG circuit 203 to operate as a shift register, and controls multiplexer/encryption circuit 206 to operate as a multiplexer so that the contents of 11-bit RS/PRNG circuit 203 are serially supplied to transmitter circuit 207 in nonencrypted form (step 310). Control circuit 208 then clocks the 13-bit RS/PRNG circuit 204, controls 13-bit RS/PRNG circuit 204 to operate as a shift register, and controls multiplexer/encryption circuit 206 so that the contents of 13-bit RS/PRNG circuit 204 are serially supplied to transmitter circuit 207 in nonencrypted form (step 312). Lastly, control circuit 208 clocks the 16-bit RS/PRNG circuit 205, controls 16-bit RS/PRNG circuit 205 to operate as a shift register, and controls multiplexer/encryption circuit 206 so that the pseudo-random count value present in 16-bit RS/PRNG circuit 205 is serially supplied to transmitter circuit 207 in nonencrypted form (step 314). The three values output from RS/PRNG circuits 203, 204, and 205, when serially combined into a serial bit stream, are called the "synchronization code" and are incorporated into a message.

The bits of the synchronization code are transmitted from transmitting unit 100 in serial fashion by transmitter circuit 207. Transmitting unit 100 then enters a "standby mode" and waits for pushbutton 101 to be depressed.

Receiving unit 150 is and remains in a "standby mode" until a message is received (step 316). After a message is received, receiving unit 150 enters a "synchronization mode" and extracts from the transmitted synchronization code the 11-bit "start value", the 13-bit "start value", and the 16-bit pseudo-random value (step 318) which were present in RS/PRNG circuits 203, 204, 205 of the transmitting unit 100, respectively. The 11-bit and 13-bit start values received are compared with an 11-bit start value and a 13-bit start value stored in receiving unit 150, respectively (step 320). If the respective received start values do not match the respective stored start values (step 322), then receiving unit 150 enters standby mode and waits for the next transmission. If, on the other hand, the respective received and stored start values do match (step 322), then receiving unit 150 adopts the 16-bit pseudo-random count value of the received synchronization code as its 16-bit pseudo-random count value (step 324). Receiving unit 150 then enters an "operation mode" and waits for the next message to be transmitted (step 326).

When pushbutton 101 of transmitting unit 100 is depressed, 11-bit, 13-bit, and 16-bit RS/PRNG circuits 203, 204, and 205 in transmitting unit 100 operate as pseudo-random number generators and increment once to generate the next sequential 11-bit, 13-bit, and 16-bit pseudo-random values (step 328). After the new 11-bit, 13-bit, and 16-bit pseudo-random values are generated, RS/PRNG circuits 203, 204, and 205 operate as ring shift registers and are clocked N times to output one bit of each of their respective values to multiplexer/encryption circuit 206 on each clock via leads 216, 217, and 218, respectively (step 330). Multiplexer/encryption circuit 206, rather than operating as a multiplexer, operates to encrypt the three N-bit binary values into a single N-bit encrypted output value called a "verification code" (step 330). In some embodiments, N is 24 so that the 11-bit, 13-bit and 16-bit values in the three RS/PRNG circuits are clocked as shift registers twenty-four times to result in a 24-bit verification code. Multiplexer/encryption circuit 206 may involve an internal 24-bit buffer register to intermediately store the verification code for later assembly into a complete message. Multiplexer/encryption circuit 206 may therefore have additional data input leads for receiving bits of other fields of the message. The message containing the verification code is then serially output from multiplexer/encryption circuit 206 to transmitter 207 via lead 219 and is transmitted to receiving unit 150 by transmitter circuit 207 (step 330).

Upon receiving the transmission, receiving unit 150 uses the same method used by the transmitting unit to generate next 11-bit, 13-bit and 16-bit pseudo-random values from the 11-bit, 13-bit and 16-bit start values (step 332). The respective 11-bit, 13-bit, and 16-bit new pseudo-random values generated in receiving unit 150 are then encrypted in accordance with the same method employed by the hardware of the transmitting unit so as to generate an N-bit serial code called a "reference code" (step-332). The receiving unit may, for example, include hardware similar to the 11-bit, 13-bit and 16-bit RS/PRNG circuits and the encryption circuit of the transmitting unit to generate the N-bit "reference code". Alternatively, the method employed by the hardware of the transmitting unit may be realized in software executing in a microcontroller in the receiving unit.

After the reference code is generated in the receiving unit 150, the verification code as received by the receiving unit 150 is compared to the reference code generated in receiving unit 150 (step 336) to determine whether the two codes match. If there is no match, receiving unit 150 generates the next sequential reference code and determines if that next sequential reference code matches the transmitted verification code. This process is repeated until either a match is found or a predetermined number of reference codes have been generated (steps 334–342). If a match is not found within the predetermined number of attempts, receiving unit 150 enters standby mode and waits for a new synchronization code to be transmitted from transmitting unit 100 (step 344).

If a match is found, receiving unit 150 is enabled to perform a function indicated by the function code transmitted by the transmitting unit 100 (step 346) along with the verification code. Receiving unit 100 then enters standby mode and waits for the next verification code to be transmitted from transmitting unit 100 (step 348).

The operation of an embodiment of the present invention is further illustrated in connection with the following example. Suppose a valet parking attendant is entrusted with a car equipped in accordance with the present invention. Attached to the mechanical car key is transmitting unit 100. The valet removes and re-inserts battery 216 of transmitting unit 100. He/she then presses pushbutton 101 fifty-one times and, using a code copier, copies the fifty transmitted verification codes. The valet then again removes and re-installs battery 216 in transmitting unit 100, believing he/she possesses the next fifty valid verification codes for the security system. However, when the valet attempts to use the copied codes to gain entry into the car, the copied verification codes will likely not be valid.

When the valet removed battery 216 and pressed pushbutton 101 of transmitting unit 100 fifty-one times, transmitting unit 100 transmitted a first synchronization code and the first fifty verification codes following that particular first synchronization code. However, when the valet removed and re-inserted battery 216 the second time, transmitting unit 100 does not reset its synchronization code back to the first synchronization code. Rather, pressing pushbutton 101 the first time after the valet re-inserted the battery causes pseudo-random number generator 205 to generate another pseudo-random value which almost certainly results in a second synchronization code different from the first synchronization code.

Therefore, because the first verification code is dependent upon the prior synchronization code, and because each successive verification code is dependent upon its preceding verification code, none of the fifty verification codes copied by the thief will likely match the verification code being expected by the receiving unit. If, for example, RS/PRNG circuit 205 has 16-bits, and if RS/PRNG circuit 205 is shifted 24 times to result in a 24-bit encrypted verification code, and the thief copies fifty messages containing fifty consecutive 24-bit verification codes, there is in the range of a $50/2^{24}$ or smaller chance that the thief will have copied a verification code which would be considered valid by the receiving unit. Of course, the 16-bit RS/PRNG circuit 205 can be made to have greater than sixteen bits and an encrypted verification code of more than twenty-four bits can be realized if desired.

The fixed start values used by the receiving unit 150 to test for the proper fixed start values in RS/PRNG circuits 203 and 204 of the transmitting unit 100 prevent a thief from purchasing an extra transmitting unit and simply using that transmitting unit to resynchronize and then gain unauthorized access to an automobile. Each of the 11-bit and 13-bit RS/PRNG circuits 203 and 204 can be made to have more bits. Even if the thief were able to determine the start values of a particular automobile from the synchronization code of a transmitting unit, and even if the thief knew the significance of the start values, the thief would be unable to reprogram the extra transmitting unit because the non-volatile memory of each transmitting unit is made one-time-programmable by a programming disable fuse. Moreover, it is likely that the thief will purchase a transmitting unit having a different mask option block 202 from the mask option block 202 of the real transmitting unit.

In accordance with other embodiments, the period of time 16-bit RS/PRNG circuit 203 generates a sequence of pseudo-random values after a power-up is determined not by a period of time between the battery being replaced and the manually-operable switch being depressed, but rather is dependent upon a period of time that the manually-operable switch is held depressed. 16-bit RS/PRNG circuit 203 may, for example, be serially loaded with all ones when the 11-bit and 13-bit RS/PRNG circuits are initially serially loaded with the fixed "start values". Then subsequently when manually-operable switch 101 is depressed, 16-bit RS/PRNG circuit 203 may be made to generate a sequence of pseudo-random values until the switch is released. Upon release of the switch, the contents of the three RS/PRNG circuits are assembled into a synchronization code and the synchronization code is transmitted to the receiving unit. Alternatively, 16-bit RS/PRNG circuit 203 may generate a sequence of pseudo-random values throughout the period from the battery being replaced until the manually-operated switch is released. Other methods of generating a different values after power up for use in a synchronization code are also possible and are also considered within the scope of the present invention.

In some embodiments the 16-bit RS/PRNG circuit 203 generates a sequence of pseudo-random values when the manually-operable switch is depressed a first time, the synchronization code being transmitted when the manually-operable switch is depressed the next time.

The above-described valet problem may also be solved by storing a binary value which is changed from transmission to transmission so as to generate a transmission bit sequence that changes from transmission to transmission. By storing the changing binary value, the binary value can be reloaded after a power down condition to prevent the transmitting unit from transmitting the same bit sequence after a power down condition. An impending power down condition can be detected and the contents of the three RS/PRNG circuits stored in EEPROM before power is lost. Alternatively, nonvolatile memory is always updated after new contents of the RS/PRNG circuits are generated so that an impending power down condition need not be detected. It is to be understood that this technique of storing a binary value which is used to generate a transmission bit sequence which changes from transmission to transmission is not limited to a particular type of pseudo-random number sequence, is not limited to a particular transmission bit format, and is not limited to require an initial value to be dependent upon when or how long a switch is activated. Because writing to an EEPROM generally requires a relatively higher voltage than does operating the remainder of the transmitting unit circuitry, it is generally preferable to use the pushbutton randomizing technique over the storing technique to generate different synchronization codes after power ups in battery powered transmitting units.

To increase the difficulty of gaining entry into the automobile in the event of a thief copying numerous codes and then resetting the transmitting unit as described in the valet example above, the receiving unit may, in certain embodiments, also determine a range of verification codes around the verification expected. If the receiving unit receives a verification code transmitted to it which is not a verification code in this range, the receiving unit will sound an alarm. The receiving unit may also time out and receive no further verification codes for testing if, for example, more than a certain number of verification codes are transmitted at the receiving unit in a predetermined window of time. To transmit more verification codes, the valet would have to wait a given amount of time for the receiving unit to again begin receiving and testing verification codes. In certain embodiments, the receiving unit will sound an alarm and test no additional verification codes if the receiving unit receives a verification code which was previously valid and was previously received by the receiving unit. In such embodiments, one transmission of a previously valid verification code by a valet attempting to use the copied codes may result in an alarm condition.

In the event that the receiving unit either sounds an alarm or disables reception of further verification codes, an automobile parked in a garage where the verification codes of numerous other automobiles are likely to be transmitted within the range of the receiving unit may result in frequent false alarm conditions. Accordingly, an additional "key identifier code" field of a message containing a verification code field is provided. Such a key identifier code may be programmed to be specific to the specific automobile. Once a transmitting unit is programmed with a key identifier code, the key identifier code is fixed and does not change upon removal and replacement of the battery. After the receiving unit is programmed to operate with the particular key identifier code of one automobile, the receiving unit can distinguish messages which are intended for other automobiles. If a received message has an incorrect key identifier code, the receiving unit will treat the message as if no message were received and the receiving unit will not attempt to verify the verification code contained in the message. Accordingly, false alarms in crowded parking garages are averted.

FIG. 4A is a diagram of a message containing a synchronization code in accordance with the present invention. FIG. 4B is a diagram of a message containing a verification code in accordance with the present invention. The first field, called "Sync", is a particular synchronization sequence which allows the receiving unit to synchronize to following bits in the message. The data field indicates which one of four manually-operable switches of the transmitting unit is pressed.

Figure 5A:
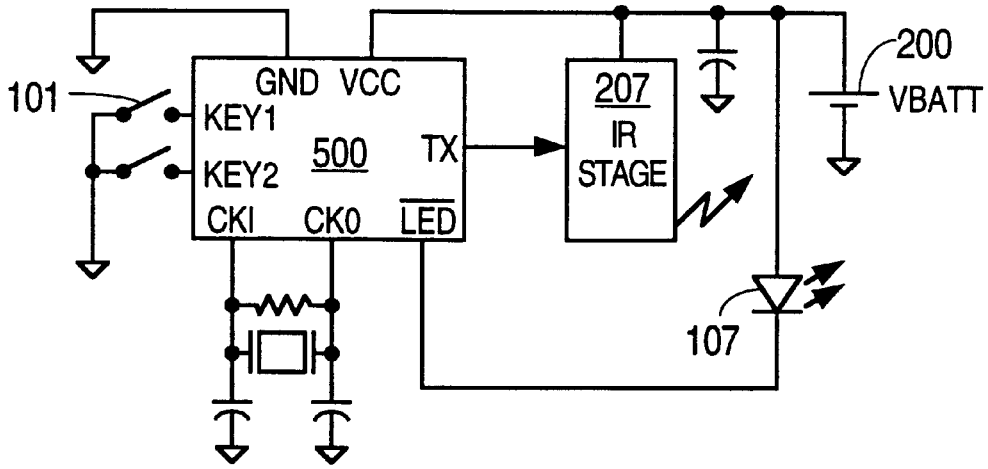
FIGS. 5A and 5B illustrate transmitting units utilizing an integrated circuit in accordance with embodiments of the present invention.
Figure 5B:
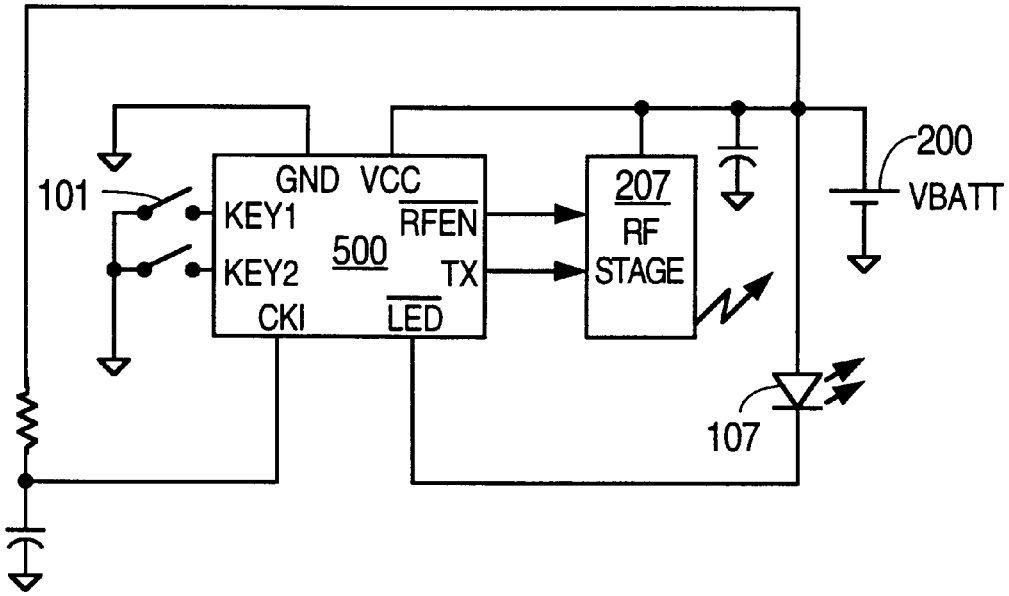

FIG. 5A illustrates a transmitter unit for transmitting radio signals and incorporating an integrated circuit 500 in accordance with an embodiment of the present invention. FIG. 5B illustrates a transmitter unit for transmitting infrared radiation and incorporating the integrated circuit 500 in accordance with an embodiment of the present invention.

Appendix A is a specification for an integrated circuit in accordance with a specific embodiment of the present invention.

Figure 6A:
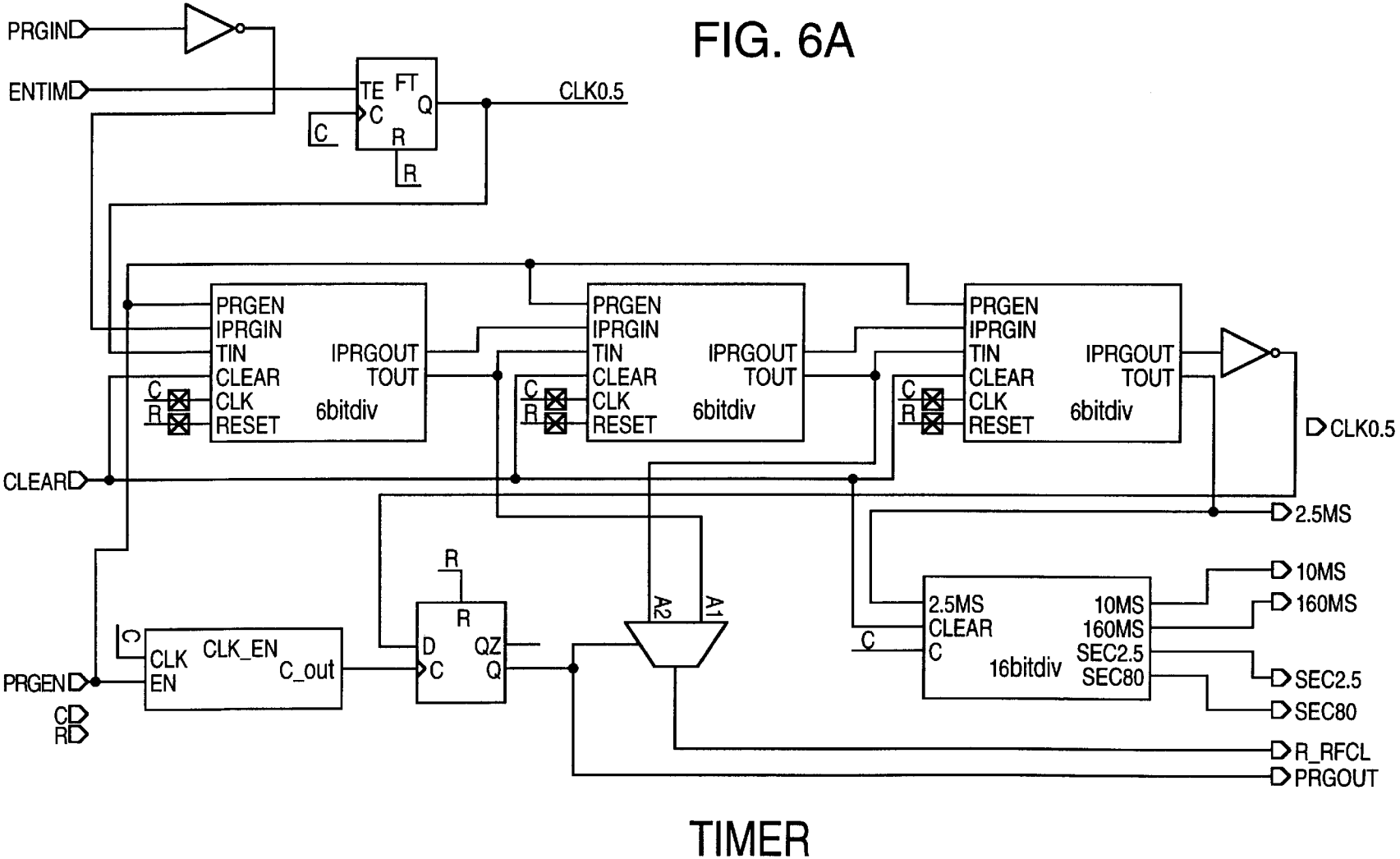
FIGS. 6A–6S are schematics of three blocks of an integrated circuit embodiment in accordance with the present invention.
Figure 6B:
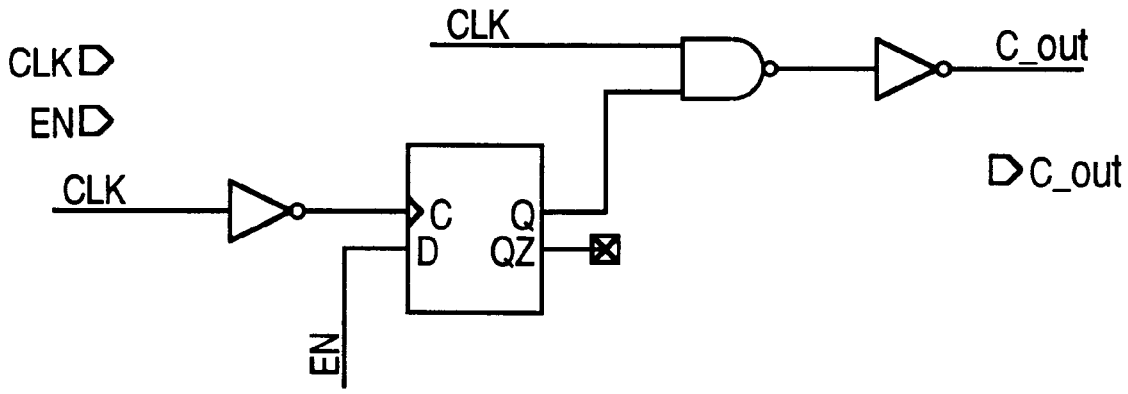
Figure 6C:
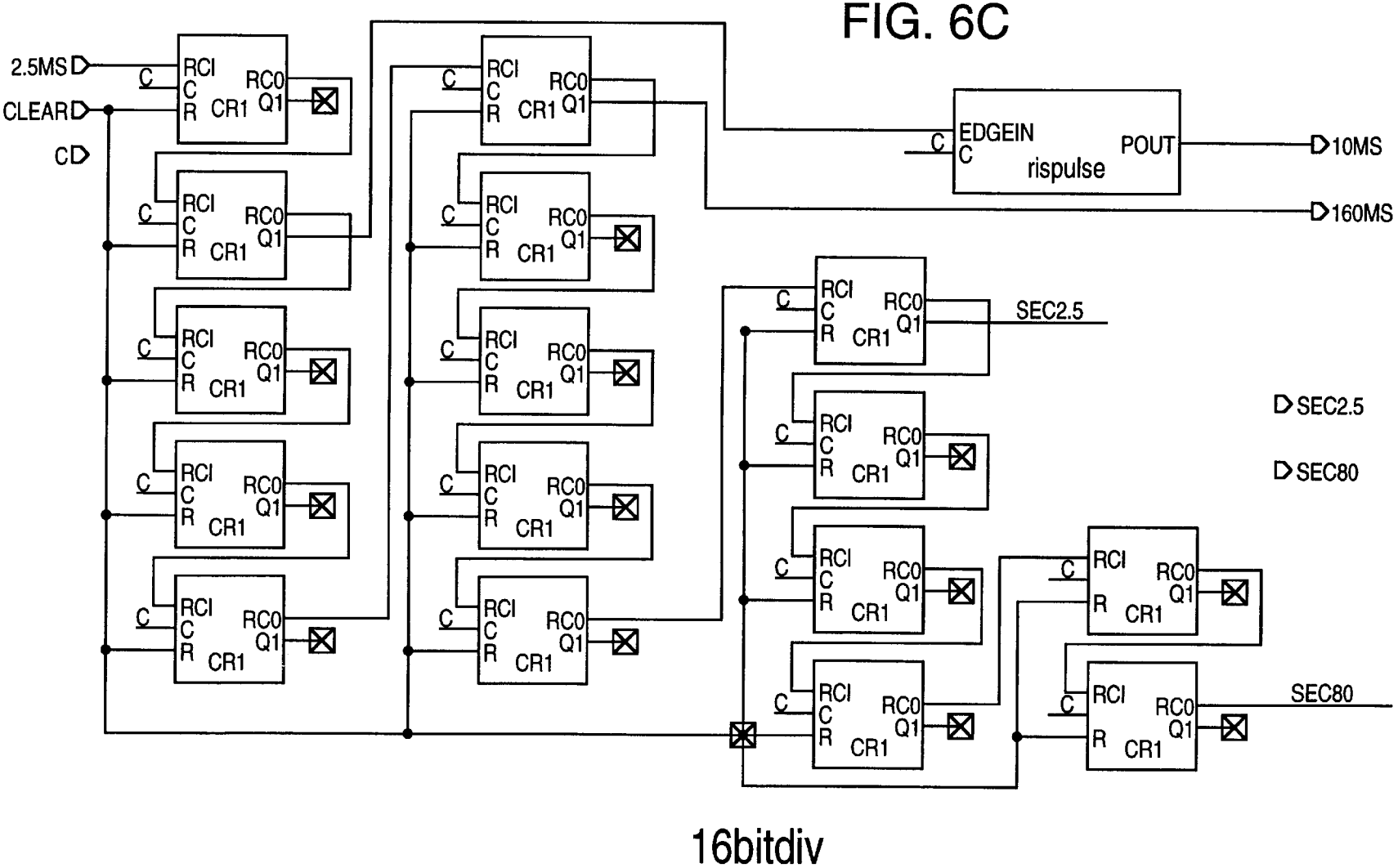
Figure 6E:
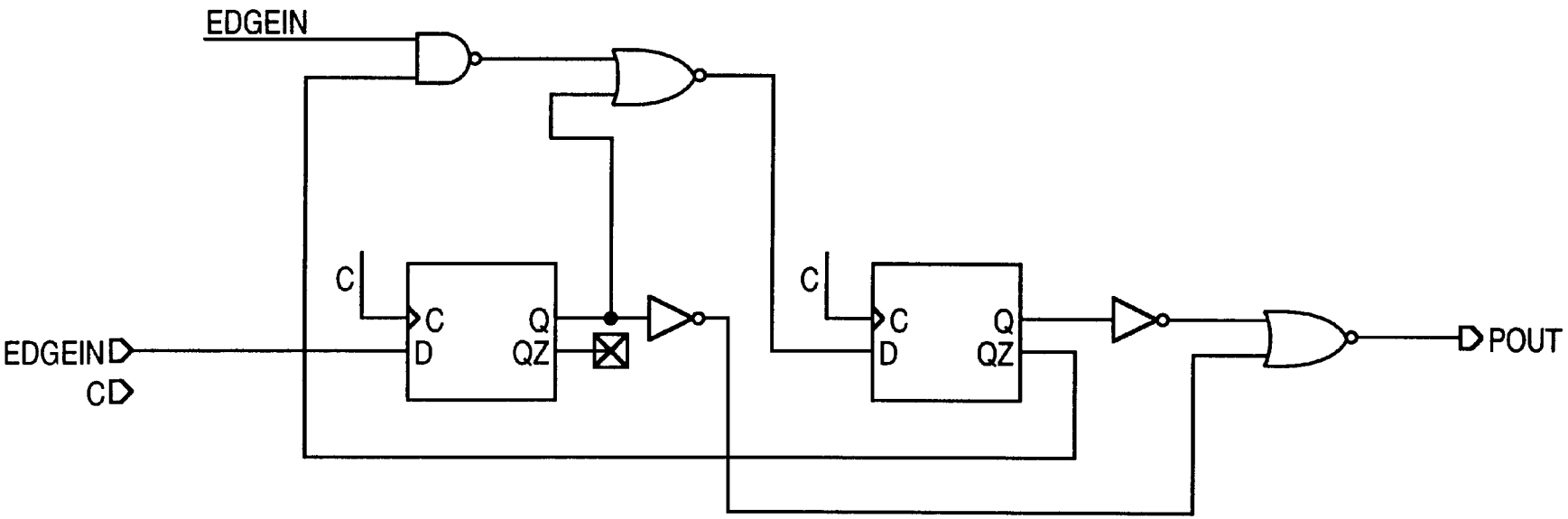
Figure 6F:
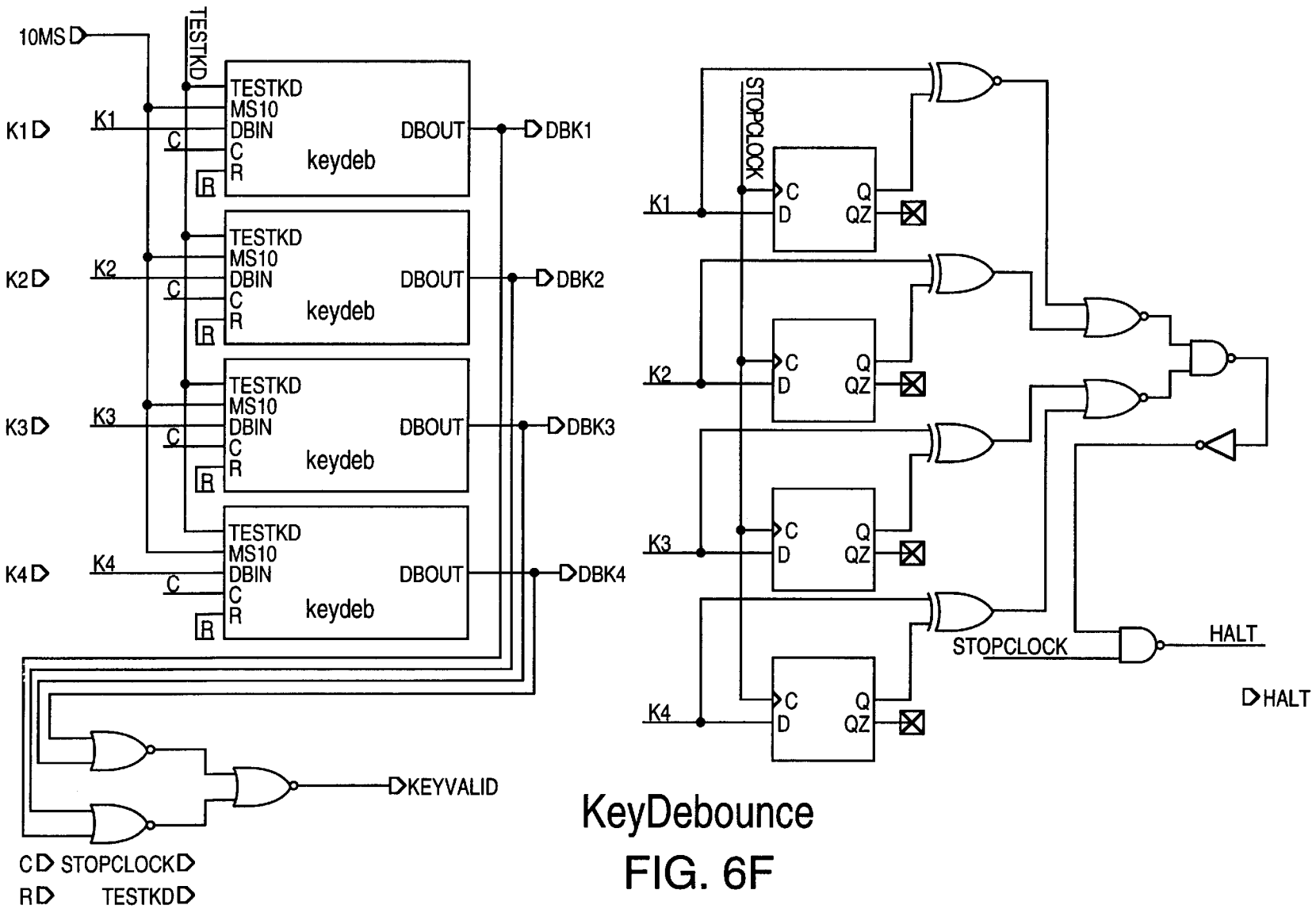
Figure 6G:
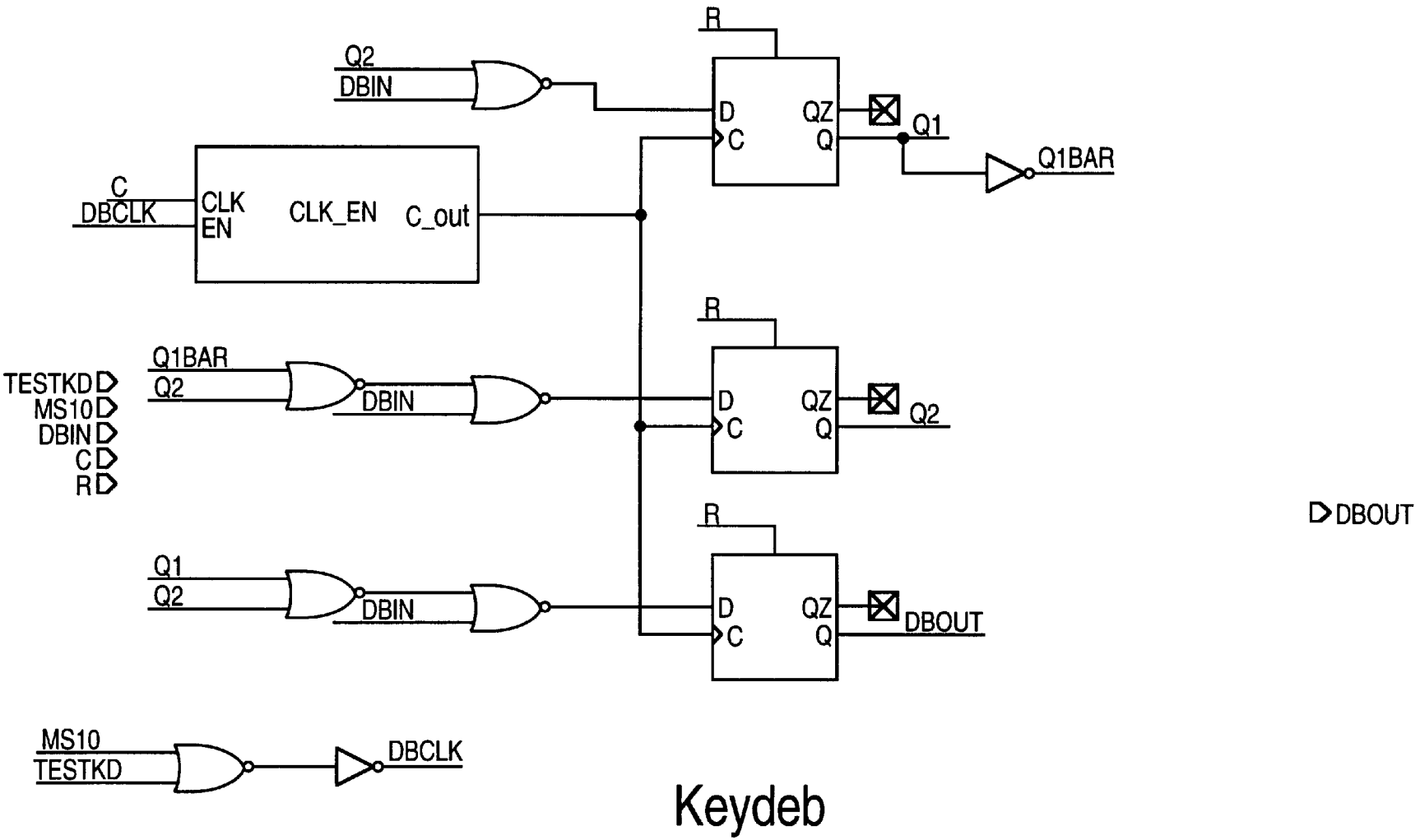
Figure 6H:
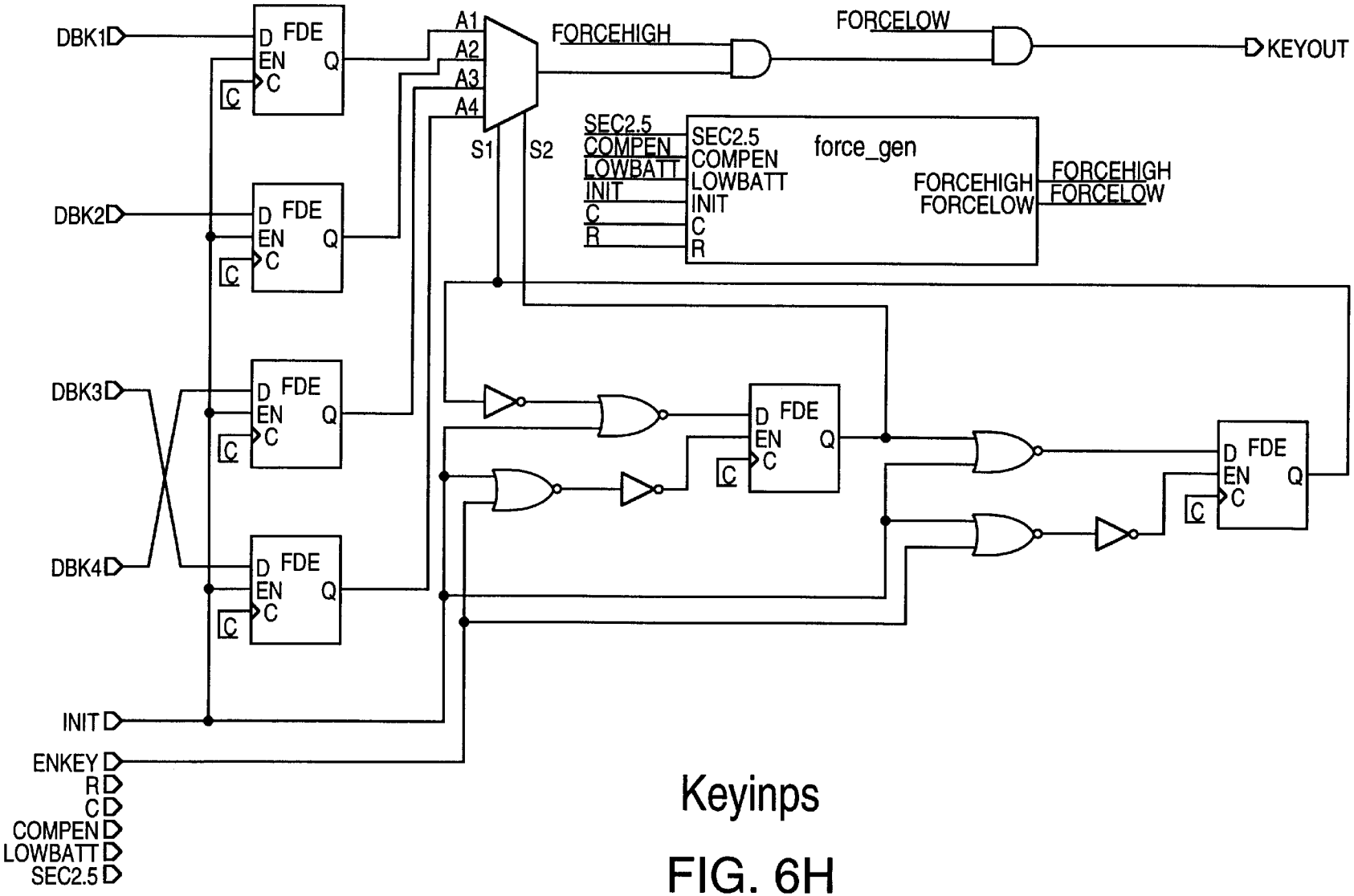
Figure 6N:
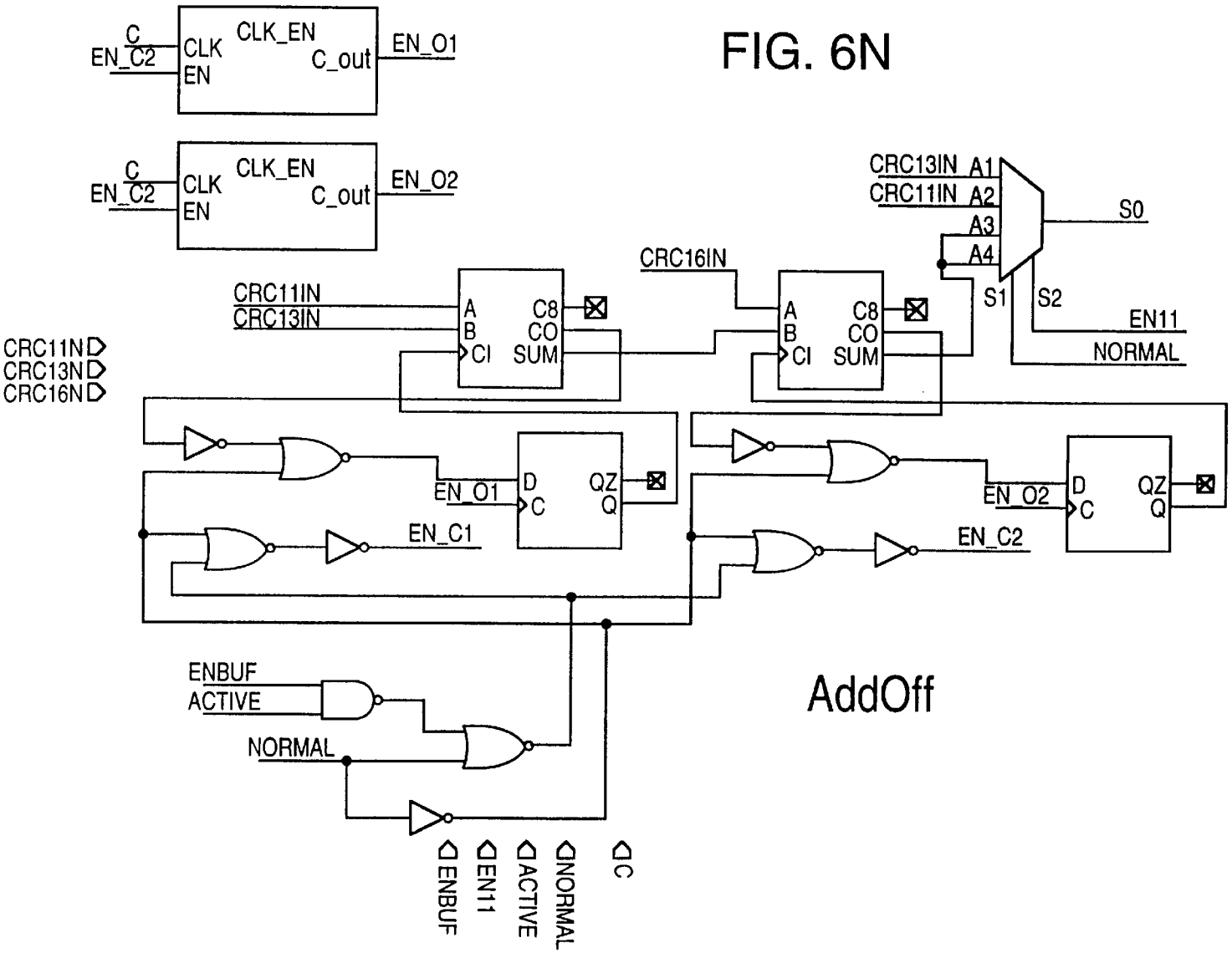
Figure 6O:
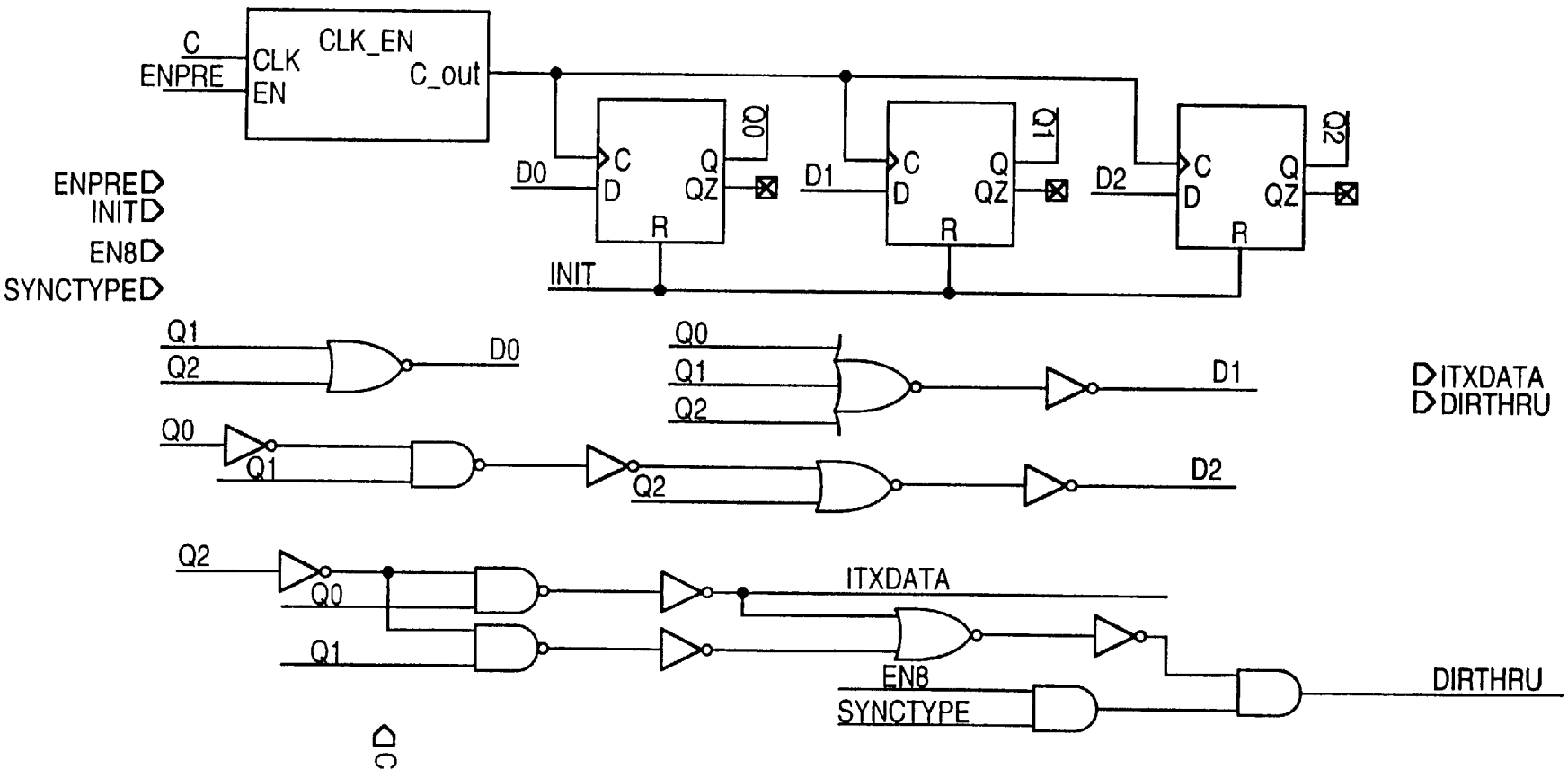
Figure 6P:
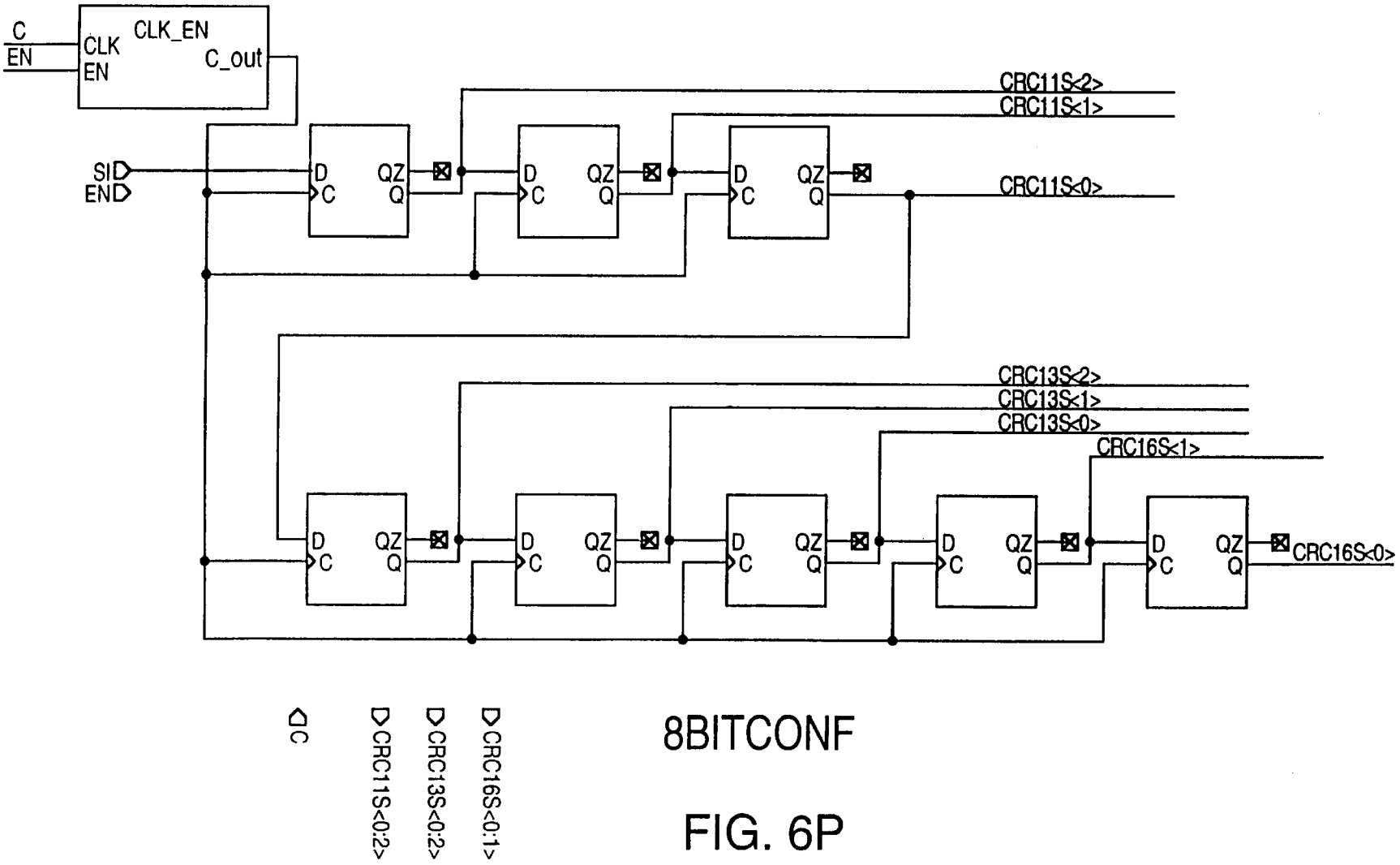

Appendix B includes descriptions of multiple low level blocks of a specific embodiment written in the Verilog hardware description language. Three of the low level blocks (a code generator block, a timer block, and a key debounce block ) are described in Verilog. Schematics of these three blocks are also supplied in the form of FIGS. 6A–6S. Four other of the low level blocks (a frame generator block, a master controller block, a pulse-width modulator block, and shared counter block) are described in the state machine description language OPAL. The OPAL language is available from National Semiconductor, 2900 Semiconductor Drive, Santa Clara, Calif. 95052. Additionally, a clock oscillation circuit, a power-on reset circuit, a block of EEPROM, and an analog comparator may be included in an integrated circuit in accordance with certain embodiments of the present invention. Conventional circuitry may be used for these additional blocks. The low level blocks of Appendix B when interconnected form an integrated circuit embodiment in accordance with the present invention.

In some embodiments, the transmitting unit includes a low voltage supply detector. If a low battery voltage is detected by the low voltage supply detector, the transmitting unit alerts the receiving unit of the low battery voltage condition by transmitting a predetermined "low battery" value (for example, via the data field) of the next verification frame. The receiving unit in the automobile can then indicate to the driver the low battery condition by any suitable means such as by lighting a light emitting diode.

In some embodiments, a battery replacement counter is employed in the transmitting unit and a second battery replacement counter is employed in the receiving unit. In one possible embodiment, a value stored in nonvolatile memory is incremented each time the transmitting unit is powered up. This stored value indicative of the number of times power has been supplied to the transmitting unit is sent to the receiving unit in all messages containing a synchronization code. The receiving unit is therefore able to alert the owner if a message containing a synchronization code has been received from a transmitting unit, the battery removal counter of which is indicated to be different than expected. If the owner has not removed the battery from the owner's transmitting unit, the owner will be alerted of a possible attempt to obtain unauthorized entry.

Although specific embodiments of the present invention have been described for instructional purposes in order to illustrate the present invention, the present invention is not limited thereto. The present invention sees application in numerous security applications other than vehicle security systems including home security systems and garage door openers. The present invention is not limited to require pseudo-random number generators or any particular type of pseudo-random number generator. Ring shift register/pseudo-random number generator 205 may, for example, be replaced with a shift-register/counter. Synchronization codes may be encrypted, nonencrypted, or partially encrypted. Multiplexer/encryption circuit 206 may comprise more than three input leads so that fields of a message other than the synchronization code field can be assembled to form a complete message. In some embodiments, messages do not include a key identifier code. Power may be provided by means other than a battery. Different values may be generated in the transmitting unit for use in generating different respective synchronization codes after successive applications of power by other than use of an activation signal generated by depressing a manually-operable switch.

Accordingly, various adaptations, modifications and substitutions of various of the features of the specific embodiments described can be practiced without departing from the scope of the invention as defined in the appended claims.

I claim:

1. A method, comprising the steps of:

(a) powering up an integrated circuit;

(b) causing said integrated circuit to transition through a first number of states to generate a first binary number;

(c) using said first binary number to generate a first synchronization code and to output said first synchronization code onto an output terminal of said integrated circuit;

(d) after step (c), generating a second binary number by causing said integrated circuit to transition a predetermined number of times;

(e) using said second binary number to generate a verification code and to output said verification code onto said output terminal of said integrated circuit;

(f) after steps (a) through (e), powering down said integrated circuit;

(g) after step (f), powering up said integrated circuit;

(h) after step (g), causing said integrated circuit to transition through a second number of states to generate a third binary number; and (i) using said third binary number to generate a second synchronization code and to output said second synchronization code onto said output terminal of said integrated circuit, wherein said integrated circuit comprises a first pseudo-random number generator and a second pseudo-random number generator, said method further comprising the steps of:

(b1) after step (a) and before said first synchronization code is generated, loading said first pseudo-random number generator with a predetermined value; and (h1) after step (g) and before said second synchronization code is generated, loading said first pseudo-random number generator with said predetermined value; and wherein step (d) of generating a second binary number further comprises the steps of:

causing said first pseudo-random number generator to transition to a new state; and causing said second pseudo-random number generator to transition to a new state.

2. The method of claim 1, wherein said predetermined value is stored in a nonvolatile memory.

3. A method of operation of a transmitting unit for a wireless security system, comprising the steps of:

(a) generating a synchronization code A in said transmitting unit after power is supplied to said transmitting unit at one time but before power is supplied a second time, said synchronization code A being the first synchronization code generated in said transmitting unit after power is supplied said one time;

(b) generating a plurality of randomized rolling verification codes in said transmitting unit after step (a), each of said plurality of randomized rolling verification codes being generated by causing said transmitting unit to transition a respective predetermined number of states; and (c) generating a synchronization code B in said transmitting unit after power is supplied to said transmitting unit said second time, said synchronization code B being the first synchronization code generated in said transmitting unit after power is supplied said second time, said synchronization code B being different than said synchronization code A.

4. The method of claim 3, wherein each successive one of said plurality of randomized rolling verification codes is caused by a respective depressing of a switch of said transmitting unit.

5. The method of claim 4 further comprising the steps of:

receiving said synchronization code A and one of said plurality of randomized rolling verification codes in a receiving unit of said wireless security system;

in said receiving unit, generating a reference code from said synchronization code A; and in said receiving unit, comparing said reference code with said one of said plurality of randomized rolling verification codes.

6. The method of claim 5, further comprising the step of:

in the event said reference code and said one of said plurality of randomized rolling verification codes do not match in said comparing step, generating other reference codes in said receiving unit and comparing each of said other reference codes with said one of said plurality of randomized rolling verification codes until either a reference code matches said one of said plurality of randomized rolling verification codes or until a predetermined number of reference codes have been compared.

7. The method of claim 5, wherein said step of generating said reference code in said receiving unit comprises the step of:

loading said synchronization code A said reference code generated by causing said receiving unit to transition a predetermined number of states.

8. The method of claim 5, further comprising the steps of:

programming a key identifier code into said transmitting unit, and programming a key identifier code into said receiving unit;

transmitting said key identifier code programmed into said transmitting unit along with said one of said plurality of randomized rolling verification codes from said transmitting unit to said receiving unit; and in said receiving unit, comparing said key identifier code transmitted from said transmitting unit to said key identifier code programmed into said receiving unit.

9. The method of claim 8, wherein said key identifier code is transmitted before said one of said plurality of randomized rolling verification codes.

10. The method of claim 8, wherein said key identifier code programmed into said transmitting unit is stored in a non-volatile memory of said transmitting unit.

11. The method of claim 5, further comprising the steps of:

transmitting a function code along with said one of said plurality of randomized rolling verification codes from said transmitting unit to said receiving unit; and said receiving unit enabling a function indicated by said function code if said comparing step indicates that said reference code matches said one of said plurality of randomized rolling verification codes.

12. The method of claim 3, wherein step (a) further comprises the steps of:

(a1) shifting a first pseudo-random number generator to generate a first serial bit stream;

(a2) shifting a second pseudo-random number generator to generate a second serial bit stream; and (a3) converting said first and second serial bit streams into said synchronization code A, and wherein step (c) further comprises the steps of;

(c1) shifting said first pseudo-random number generator to generate a third serial bit stream;

(c2) shifting said second pseudo-random number generator to generate a fourth serial bit stream; and (c3) converting said third and fourth serial bit streams into said synchronization code B.

13. The method of claim 12, wherein said second pseudo-random number generator generates a sequence of values in step (a) before step (a2) for a period of time which is at least in part dependent upon a manipulation of a switch, said second serial bit stream being different from said fourth serial bit stream, said first serial bit stream being identical to said third serial bit stream.

14. The method of claim 13, wherein said converting step (a3) includes time multiplexing said first and second serial bits streams to form said synchronization code A, and wherein said converting step (c3) includes time multiplexing said third and fourth serial bit streams to form said synchronization code B.

15. A transmitting unit for a wireless security system, comprising:

a manually-operable switch;

an integrated circuit having an input terminal and an output terminal, said input terminal being coupled to receive an activation signal from said switch, said integrated circuit outputting a randomized synchronization code onto said output terminal after said integrated circuit is powered up one time, said integrated circuit outputting a plurality of randomized rolling verification codes onto said output terminal after said randomized synchronization code is output but before said integrated circuit is powered up a second time; and a battery coupled to provide power to said integrated circuit.

16. The transmitting unit of claim 15, further comprising a transmitter circuit having an input terminal, wherein, said integrated circuit comprises:

a pseudo-random number generator circuit having an output terminal; and a multiplexer circuit having a data input terminal and a data output terminal, said data input terminal of said multiplexer circuit being coupled to said output terminal of said pseudo-random number generator circuit, said data output terminal of said multiplexer circuit communicating with said input terminal of said transmitter circuit.

17. The transmitting unit of claim 16, wherein said battery has a voltage, said integrated circuit further comprising a low battery voltage detector having an input terminal coupled to said battery, said low battery voltage detector outputting a signal in the event said voltage falls below a predetermined level.

18. The transmitting unit of claim 15, wherein said integrated circuit comprises:

a pseudo-random number generator, wherein depressing said switch a first time after said integrated circuit is powered up said one time causes said pseudo-random number generator to stop generating a sequence of pseudo-random numbers, and wherein said depressing said manually-operable switch a first time after said integrated circuit is powered up said second time causes said pseudo-random number generator to stop generating another sequence of pseudo-random numbers.

19. The transmitting unit of claim 15, wherein said integrated circuit comprises:

a pseudo-random number generator, wherein releasing said manually-operable switch a first time said integrated circuit is powered up said one time causes said pseudo-random number generator to stop generating a sequence of pseudo-random numbers, and wherein releasing said manually-operable switch a first time after said integrated circuit is powered up said second time causes said pseudo-random number generator to stop generating a sequence of pseudo-random numbers.

20. The transmitting unit of claim 15, wherein said switch is a push-button, and wherein said integrated circuit comprises:

a pseudo-random number generator which is enabled to generate a sequence of pseudo-random numbers for a period of time of approximately the same duration as a period of time said switch is depressed.

21. The transmitting unit of claim 15, wherein said integrated circuit comprises:

a number generator which outputs a binary value when said integrated circuit is powered down after said integrated circuit is powered up said one time and before said integrated circuit is powered up said second time; and a nonvolatile memory coupled to said number generator, said nonvolatile memory supplying said binary value to said number generator when said integrated circuit is powered up said second time.

22. The transmitting unit of claim 15, wherein said integrated circuit comprises a low battery voltage detector having an input terminal coupled to a battery, said low battery voltage detector outputting a signal in the event a voltage of said battery falls below a predetermined level, each of said plurality of randomized rolling verification codes output onto said output terminal of said integrated circuit being one field of a respective one of a plurality of messages, each of said plurality of messages comprising a randomized rolling verification code field also comprising a data field, at least one of said data fields being indicative of a low battery voltage in the event of said signal being output.

23. The transmitting unit of claim 22, wherein said integrated circuit further comprises a non-volatile memory storing a key identifier code, and each of said plurality of messages comprising a randomized rolling verification code field also comprising a key identifier code field, bits of said key identifier code field being indicative of said key identifier code stored in said non-volatile memory.

24. A method of operation of a wireless security system, said security system comprising a mobile transmitting unit and a receiving unit, comprising:

generating first synchronization code information in said transmitting unit after power is supplied at one time to said transmitting unit;

transmitting said first synchronization code information from said transmitting unit to said receiving unit;

in said transmitting unit, using said first synchronization code information to generate verification code information in accordance with an encryption method;

in said receiving unit, using said first synchronization code information to generate reference code information exactly equal to said verification code information in accordance with said encryption method;

transmitting said verification code information from said transmitting unit to said receiving unit;

in said receiving unit, comparing said verification code information received from said transmitting unit to said reference code information generated in said receiving unit; and in said transmitting unit, generating and transmitting second synchronization code information different from said first synchronization code information after power is interrupted and then supplied to said transmitting unit.

25. The method of claim 24, wherein said first synchronization code information transmitted after power is supplied at one time to said transmitting unit is the first synchronization code information transmitted from said transmitting unit after power is supplied to said transmitting unit at said one time, and wherein said second synchronization code information transmitted after power is supplied to said transmitting unit said second time is the first synchronization code information transmitted from said transmitting unit after power is supplied to said transmitting unit said second time.

26. A transmitting unit for a wireless security system, comprising:

a manually-operable switch;

means having an input terminal and an output terminal, said input terminal being coupled to receive an activation signal from said switch, said means outputting a randomized synchronization code onto said output terminal after said means is powered up, said synchronization code being at least in part dependent on a tuning of said activation signal, said means also outputting a rolling verification code onto said output terminal after said randomized synchronization code is output onto said output terminal; and a battery coupled to provide power to said means.

27. The transmitting unit of claim 26, wherein said means comprises:

means for storing a fixed start code, and having an output terminal;

means for generating a first pseudo-random number based on said fixed start code, having an input terminal and an output terminal, said input terminal of said means for generating a first pseudo-random number being coupled to said output terminal of said means for storing;

means for generating a second pseudo-random number generator based on a manipulation of said switch, and having an output terminal; and means for generating either said randomized synchronization code or said rolling verification code having a first input terminal and a second input terminal, said output terminal of said means for generating a first pseudo-random number being coupled to said first input terminal of said means for generating either said randomized synchronization code or said rolling verification code, said output terminal of said means for generating a second pseudo-random number being coupled to said second input terminal of said means for generating either said randomized synchronization code or said rolling verification code.

28. A transmitting unit for a wireless security system, comprising:

a manually-operable switch; and means having an input and an output, said input being coupled to receive an activation signal from said switch, said means outputting a synchronization code onto said output after said means is powered up, the value of said synchronization code being at least in part dependent on a timing of said activation signal, said means also outputting rolling verification codes onto said output after said synchronization code is output onto said output.

29. The transmitting unit of claim 28, wherein said means comprises a pseudo-random number generator and said synchronization code value comprises a pseudo-random number value generated by said pseudo-random number generator.

30. The transmitting unit of claim 29, wherein said pseudo-random number generator determines said pseudo-random number value dependent at least in part on said timing.

31. The transmitting unit of claim 30 wherein said pseudo-random number generator generates a plurality of said successive pseudo-random number values from a predetermined start value and determines the last pseudo-random number value, at the time said activation signal is received from said switch, for said inclusion in said synchronization code value.

32. The transmitting unit of claim 29, wherein said pseudo-random number value is included in a nonencrypted form in said synchronization code.

* * * * *